US006584442B1

(12) United States Patent
Suzuki et al.

(10) Patent No.: US 6,584,442 B1
(45) Date of Patent: Jun. 24, 2003

(54) METHOD AND APPARATUS FOR COMPRESSING AND GENERATING WAVEFORM

(75) Inventors: Hideo Suzuki, Hamamatsu (JP); Masao Sakama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/536,007

(22) Filed: Mar. 23, 2000

(30) Foreign Application Priority Data

Mar. 25, 1999 (JP) ..... 11-082649
Mar. 26, 1999 (JP) ..... 11-084971
Mar. 26, 1999 (JP) ..... 11-084972

(51) Int. Cl.[7] ..... G10L 9/14; G10L 13/02
(52) U.S. Cl. ..... 704/500; 704/222; 84/600
(58) Field of Search ..... 704/219, 220, 704/208, 222, 223, 500, 501, 503; 84/600, 604

(56) References Cited

U.S. PATENT DOCUMENTS 5,732,389 A * 3/1998 Kroon et al. ..... 704/223
5,828,811 A * 10/1998 Taniguchi et al. ..... 704/220
5,963,897 A * 10/1999 Alpuente et al. ..... 704/219
5,974,387 A * 10/1999 Kageyama et al. ..... 704/500
6,003,001 A * 12/1999 Maeda ..... 704/223
6,263,312 B1 * 7/2001 Kolesnik et al. ..... 704/500

* cited by examiner

*Primary Examiner*—Daniel Abebe
(74) *Attorney, Agent, or Firm*—Morrison & Foerster LLP

(57) ABSTRACT

Input waveform data are processed by Fast Fourier Transform or otherwise to separate a harmonic wave component from the waveform data while a non-harmonic wave component is separated by subtracting the harmonic wave component from the waveform data. Vector quantization is performed on the harmonic wave component by selecting and using one of prestored harmonic vectors as a representative vector for the harmonic wave component, and vector quantization is performed on the non-harmonic wave component, independently of the harmonic wave component, by selecting and using one of prestored non-harmonic vectors as a representative vector for the non-harmonic wave component. Then, using harmonic and non-harmonic vectors indicated by vector information of a waveform to be reproduced, waveforms of harmonic and non-harmonic wave components are generated separately and then combined to thereby reproduce/generate the waveform. The non-harmonic wave component is divided, on the basis of detected periodicity of the corresponding harmonic wave component, into a plurality of sections each having a length corresponding to an integral or fractional multiple of the period of the harmonic wave component.

39 Claims, 12 Drawing Sheets

METHOD AND APPARATUS FOR COMPRESSING AND GENERATING WAVEFORM

BACKGROUND OF THE INVENTION

The present invention relates generally to methods of compressing waveforms of musical tones, voices and various other sounds by use of a vector quantization technique. More particularly, the present invention relates to an improved waveform compression method which can efficiently compress waveform data, e.g., in a situation where a great number of sets of waveform data are prestored in memory in corresponding relation to a variety of rendition styles (performance styles), as well as to a waveform generation method of using such an improved waveform compression method to generate a desired waveform.

The present invention also relates to a waveform generation method of generating a desired waveform using the improved waveform compression method, which is characterized by improved compression of a non-harmonic (i.e., non-periodic) wave components. The present invention relates further to an improvement method that is directed to generating a desired waveform of a non-periodic wave component.

The principles of present invention described hereinbelow can be applied so extensively to apparatus and methods in all fields which have functions of generating musical tones, voices and other sounds, such as automatic performance apparatus, computers, electronic game apparatus and other multimedia equipment, to say nothing of electronic musical instruments. Note that the terms "tone waveform" are used in this patent specification to refer to not only to a waveform of a musical tone but also a waveform of a voice or any other sound.

In the electronic tone synthesis techniques known today, the issue of how to synthesize high-quality tones taking into consideration (or reflecting) different rendition styles is getting more and more important. Namely, in the field of natural musical instruments, it has been known that even a tone of a same instrument tone color and same pitch is generated with different tonal characteristics (particularly, different tone color waveforms) in response to performance in different rendition styles, such as a vibrato rendition style and slur rendition style. When such high-quality tones reflecting differences in the rendition styles are to be generated by an electronic musical instrument or the like using an electronic tone synthesis technique, one possible approach is to prestore into memory, for each tone pitch (or range) of each instrument tone color, different sets of waveform data presenting tonal characteristics (especially, tone color waveforms) corresponding to the different rendition styles in association with the rendition styles. In this approach, a tone waveform presenting unique tonal characteristics (especially, a unique tone color waveform) corresponding to a selected rendition style can be generated by reading out one of the waveform data sets which corresponds to the selected rendition style.

In the case where different sets of waveform data are prestored, for each tone pitch (or range) of each instrument tone color, in association with a plurality of rendition styles as mentioned above, the necessary memory storage capacity has to be increased considerably if the waveform data are prestored in an ordinary manner. Thus, how to compress the waveform data efficiently and thereby save the memory storage capacity would become an important challenge. For this reason, some of the conventionally-known waveform data compression techniques which are considered most noteworthy in connection with the present invention will be discussed below.

First, Japanese Patent Laid-open Publication No. SHO-61-104400 discloses a sound recording method, in accordance with which an input waveform is separated, via a filtering process, into a periodic wave component and a non-periodic wave component and the thus-separated periodic and non-periodic wave components are encoded by use of different data-compressing coding schemes and then individually stored into a waveform memory. Although this No. HEI-61-104400 publication teaches the idea of separating specific waveform data into periodic and non-periodic wave components and storing them in compressed data formats, it does not teach the idea of vector-quantizing all of the wave components. For the non-periodic wave component, in particular, the disclosed technique can merely record a residual waveform, obtained by subtracting a waveform of the periodic wave component from the specific waveform data, in a time-serial manner just as it is.

Further, in Japanese Patent Laid-open Publication No. HEI-5-88911, there is disclosed a sound coding method using vector quantization. According to the disclosure, a sound waveform to be compressed is first processed by a filter with characteristics opposite to a spectrum extracted from the sound waveform, and then vector quantization is performed on the periodic wave component of the thus-filtered sound waveform using an excitation vector extracted from a predetermined previous cycle of the sound waveform and also-on the non-periodic wave component of the sound waveform using a noise vector. In the disclosed method, the noise vector is one provided in advance merely as a fixed vector, and the non-periodic wave component is not extracted directly from the sound waveform for the vector quantization based on the noise vector.

However, because the data compression rate is relatively low in the first-mentioned waveform data compression technique (Japanese Patent Laid-open Publication No. SHO-61-104400), it is difficult to achieve sufficient data compression that suits the purpose of storing, for each tone pitch (or range) of each instrument tone color, different sets of waveform data in association with a plurality of rendition styles. Namely, because the above-mentioned waveform data compression technique completely lacks the idea of vector-quantizing the non-periodic wave component, it can do nothing, about data storage of the non-periodic wave component, more than just recording the residual waveform (obtained by subtracting the waveform of the periodic wave component from the sound waveform) in a time series just as it is, and therefore the conventional waveform data compression technique never achieves sufficient data compression.

Further, because the second-mentioned waveform data compression technique (Japanese Patent Laid-open Publication No. HEI-5-88911) uses, as the noise vector, one previously provided as a fixed vector and, besides, is not arranged to extract the non-periodic wave component (noise component) directly from the sound waveform for the subsequent vector quantization, the vector quantization using the noise vector would be performed with poor accuracy, and the non-periodic wave component can never be compressed efficiently and also can never be reproduced with good accuracy. Further, because the filtering process is always performed using the opposite characteristics, the waveform to be reproduced would unavoidably assume a shape substantially different from the original waveform shape due to the intervention of the filtering process of the strong opposite characteristics, which would result in even poorer waveform reproducibility. Therefore, this conventional waveform data compression technique can not be used suitably for waveform reproduction of a musical instrument tone of which highly accurate waveform reproducibility is normally required, although it may be suitable for use in waveform reproduction of a human voice of which very accurate waveform reproducibility is not required. Furthermore, in this conventional waveform data compression technique, which performs the waveform compression using both the periodic vector and the noise vector, there would arise a need to perform the vector quantization, based on a combination of the periodic and noise vectors, on a single waveform having undergone the opposite-characteristic filtering process, which thus presents the problems that such a combination of the periodic and noise vectors can not be determined easily and the waveform data can not be compressed with sufficient accuracy. In addition, because the above-mentioned periodic vector is an excitation vector extracted from a previous waveform in most cases, the conventional technique would present poor followability with respect to a waveform rich in variations.

SUMMARY OF THE INVENTION

It is therefore an object of the present invention to provide a waveform compression method which achieves a superior data compressing efficiency and superior reproducibility of an original waveform. It is another object of the present invention to provide a waveform generation method of generating a desired waveform using such a waveform compression method.

Further, it is an object of the present invention to provide a waveform compression method which can effectively and efficiently compress a waveform, especially, a waveform of a non-harmonic wave component (non-periodic wave component). It is another object of the present invention to provide a waveform generation method of generating a desired waveform, especially, a desired waveform of a non-harmonic wave component, using such a waveform compression method.

According one aspect of the present invention, there is provided a waveform compression method, which comprises: a step of separating input waveform data into a harmonic wave component and a non-harmonic wave component; a step of providing a harmonic vector; a step of generating first compressed data by vector-quantizing the separated harmonic wave component using the harmonic vector; a step of providing a non-harmonic vector; and a step of generating second compressed data by vector-quantizing the separated non-harmonic wave component using the non-harmonic vector.

The present invention is characterized primarily in that input waveform data are separated into a harmonic (i.e., periodic) wave component and a non-harmonic (i.e., non-periodic) wave component and these harmonic wave component and non-harmonic wave component are individually subjected to a vector quantization process. Thus vector-quantizing both the harmonic wave component and the non-harmonic wave component according to the present invention can significantly enhance a waveform compressing efficiency. Further, the present invention can perform the vector quantization without the need for taking into account a hard-to-determine combination of a periodic vector and noise vector as in the conventionally-known techniques and is arranged to select respective vectors of the harmonic and non-harmonic wave components independently of each other, so that the present invention can perform the vector quantization process with greater facility. In addition, because the vector quantization of the non-periodic wave component is performed on the basis of the non-harmonic wave component separated or directly extracted from the original waveform, the non-periodic wave component can be reproduced with greatly increased accuracy. As a result, the present invention can significantly facilitate selection of vectors and achieve a superior compressing efficiency in the vector quantization process and superior reproducibility of the original waveform.

As an example, the harmonic wave component may be obtained by performing a frequency analysis of the input waveform data through the fast Fourier transform to extract its fundamental pitch frequency component and harmonic components out of the input waveform data. Namely, a waveform of the harmonic (periodic) wave component can be generated by performing the inverse Fourier transform using the thus-extracted fundamental pitch frequency component and harmonic components; note that the term "harmonic components" is used herein distinctly from the term "harmonic wave component". Then, a waveform of the non-harmonic wave component can be provided as a residual waveform that is derived from subtracting the waveform of the harmonic wave component from the input waveform data.

Because the harmonic wave component, in principle, can be regarded as a repetitive waveform, the harmonic wave component can be reproduced such as by using and looping a particular single- or plural-cycle waveform as a representative vector (or looping two successive representative vectors in a cross-fading fashion). Therefore, Each such representative vector can be used as a harmonic vector in the present invention. For example, the vector quantization of the harmonic wave component, separated from the input waveform data, can be performed by selecting a harmonic vector , i.e., a representative vector, and adding thereto information describing how the selected harmonic vector, i.e., representative vector, is to be used (e.g., a section where the vector is to be used, a manner in which the vector is to be looped, an amplitude envelope to be imparted to the vector, and the like).

On the other hand, it is preferable that the non-harmonic wave component be subjected to optimal vector quantization appropriate to characteristics or contents of the non-harmonic wave component in question, taking into account trade-off between promotion of data compression and waveform reproducibility. Although the non-harmonic wave component corresponds basically to a non-repetitive, random noise waveform, a waveform of a non-harmonic wave component of a necessary time length may be reproduced by performing a looping operation on a given representative vector taking into consideration a degree of importance as to its contents and position within a sounding period (this form of reproduction is called "loop reproduction"), or by using a representative vector of a necessary time length only once with no looping (this form of reproduction is called "one-shot reproduction"). In an alternative, a waveform of a given non-harmonic wave component may be reproduced by combining two or more representative vectors while switching between different combinations of the vectors in a predetermined order (this form of reproduction is called "sequence reproduction"), or the order or sequence to switch between the combinations may be set randomly so as to emphasize noise or random characteristics of the non-harmonic wave component (this form of reproduction is called "random sequence reproduction"). As mentioned above, it is preferable to use, as non-harmonic vectors, representative vectors appropriate to various optimal forms of the vector quantization. Thus, the vector quantization may be performed on the non-harmonic wave component, separated from the input waveform data, such as by selecting a non-harmonic vector, i.e., a representative vector, suitable for the non-harmonic wave component in question and adding thereto information describing how the selected harmonic vector, i.e., representative vector, is to be used (e.g., a section and/or period to which the loop reproduction, one-shot reproduction or the like is to be applied, form of an amplitude envelope to be imparted to the vector, and the like).

Each of the representative vectors or harmonic vectors of the harmonic wave components and each of the representative vectors or non-harmonic vectors of the harmonic wave components can be shaped between various different waveforms. Namely, as long as two or more different original waveforms to be compressed have a predetermined commonality in certain of their segments, then a same representative vector can be shared between the different original waveforms, as necessary, at the time of the vector quantization.

According to another aspect of the present invention, there is provided a waveform generation method, which comprises: a step of receiving first compressed data including vector information indicative of a harmonic vector and second compressed data including vector information indicative of a non-harmonic vector; a step of providing a harmonic vector; a step of synthesizing waveform data of a harmonic wave component on the basis of the first compressed data and the harmonic vector indicated thereby; a step of providing a non-harmonic vector; and a step of synthesizing waveform data of a non-harmonic wave component on the basis of the second compressed data and the non-harmonic vector indicated thereby.

With the above-mentioned arrangements, the waveform generation method can reproduce waveforms of harmonic and non-harmonic wave components, independently of each other, from the compressed data of the harmonic wave component (first compressed data) and compressed data of the non-harmonic wave component (second compressed data). Then, the original waveform can be reproduced by combining together the thus-reproduced waveforms of the harmonic and non-harmonic wave components.

According to still another aspect of the present invention, there is provided a waveform compression method, which comprises: a step of providing separately a harmonic wave component and a non-harmonic wave component of waveform data to be compressed; a step of detecting periodicity of the provided harmonic wave component; a step of dividing the non-harmonic wave component into a plurality of sections on the basis of the detected periodicity of the harmonic wave component; a step of providing a non-harmonic vector; and a step of generating compressed data of a non-harmonic wave component by vector-quantizing a non-harmonic wave component of each of the sections using the provided non-harmonic vector.

Waveform data to be compressed are separated, by means of an appropriate technique, into a harmonic wave component and a non-harmonic wave component and provided separately. According to the present invention, a vector quantization process is performed at least on the non-harmonic wave component. To vector-quantize a waveform of the non-harmonic wave component, it is desirable that the waveform of the non-harmonic wave component (i.e., non-harmonic component waveform) be divided into a plurality of sections and optimal vector quantization be performed for each of the thus-divided sections. As a preferred technique of dividing the non-harmonic component waveform into a plurality of sections, the present invention is arranged to detect periodicity of the harmonic wave component corresponding to the non-harmonic wave component and divide the non-harmonic wave component into a plurality of sections on the basis of the detected periodicity of the harmonic wave component. For example, the non-harmonic component waveform may be divided into a plurality of sections over a time period corresponding to an integral multiple or fractional multiple of a period (or cycle) of the harmonic wave component. It should be obvious that the divided sections need not necessarily be at equal intervals and may have different lengths as appropriate; for example, one of the divided sections may have a length corresponding to half the cycle of the harmonic wave component, another one of the divided sections may have a length corresponding to eight cycles of the harmonic wave component, and so on.

Such a technique of dividing the non-harmonic component waveform on the basis of the detected periodicity of the harmonic wave component allows the non-harmonic component waveform to be automatically divided into sections without requiring much human labor and thereby affords a benefit of significantly facilitating the analyzing operations. Further, in a situation where the character of the non-harmonic component waveform depends more or less on the periodicity of the harmonic wave component, the dividing technique allows an appropriate waveform division to be performed with great facility. Further, because the vector quantization of the non-periodic wave component is performed on the basis of the peculiar non-harmonic wave component constituting the original waveform in conjunction with the harmonic wave component, the present invention can reproduce the non-periodic wave component with significantly increased accuracy or reproducibility.

Specifically, when a waveform of a periodic or harmonic wave component (periodic or harmonic component waveform) is to be vector-quantized, a representative vector (a representative waveform segment) is selected ordinarily in such a section where similarity in the waveform shape is found. Thus, when vector-quantizing a non-periodic wave component (non-harmonic wave component) as well, it becomes important to perform an appropriate waveform division by judging in which of waveform regions or ranges similarity in the waveform shape is found. However, because the non-periodic wave component (non-harmonic wave component) itself presents a noise-like waveform, it is troublesome to identify, visually or otherwise, a particular range of the waveform which shows similarity in the waveform shape and it is also difficult to automatize the processing (i.e., automatically identifying a particular range of the waveform which shows similarity in the waveform shape and automatically dividing the identified range into sections). Therefore, the conventionally-known techniques did not analyze a waveform of a non-periodic wave component (non-harmonic wave component) itself to perform the vector quantization process on the non-periodic wave component independently of the periodic wave component. In contrast, the present invention can highly facilitate analysis of a non-periodic or non-harmonic component waveform itself to thereby allow the vector quantization process to be readily performed on the non-periodic wave component independently of the periodic wave component. Further, with the present invention, the waveform division can be readily automatized, taking advantage of the fact that the periodicity of the periodic or harmonic wave component can be automatically identified with ease. For example, it will be very advantageous to first set a provisional divided section every automatically-identified predetermined cycle of the harmonic wave component and then finally set an appropriate divided section through user's manual operation (which may include not only appropriately dividing the non-periodic component waveform at locations synchronized with the cycles of the harmonic wave component but also making adjustment to appropriately shift the divided locations forward or backward).

By observing a graphic display of a non-periodic wave component (non-harmonic wave component) separated in accordance with a frequency analysis, it has been newly found that there is some region where the non-periodic wave component appears to be varying in the waveform in cycles similar to those of the corresponding periodic wave component, although the waveform variation can not be separated as a periodic wave component through the frequency analysis. Therefore, dividing the non-periodic component waveform into a plurality of sections, utilizing the periodicity of the harmonic wave component and using appropriate locations synchronized with the cycles of the periodic wave component as waveform-dividing points, should be very useful for appropriately dividing the non-periodic wave component every range having similarity at the time of the vector quantization on the non-harmonic wave component. Thus, the present invention is intended to greatly facilitate the process to compress the non-harmonic wave component, so as to be very useful for realizing vector quantization of the non-harmonic wave component. Further, with such arrangements, the present invention accomplishes various superior benefits; for example, it can highly contribute to an enhanced waveform compressing efficiency and also achieves superior reproducibility of the original waveform and, in particular, the non-harmonic wave component.

Here, it is desirable that the non-harmonic wave component be subjected to optimal vector quantization appropriate to peculiar characteristics or contents of the non-harmonic wave component in question, taking into account trade-off between promotion of data compression and waveform reproducibility. For example, in the vector quantization of the non-harmonic wave component, a representative vector may be selected depending on a particular form or mode of non-harmonic wave component reproduction employed, such as the loop reproduction, one-shot reproduction, sequence reproduction or random sequence reproduction, similarly to the above-mentioned case. Also, each of the representative vector or non-harmonic vector of the non-harmonic wave components can be shared between various different waveforms, as with the above-mentioned case.

According to still another aspect of the present invention, there is provided a waveform generation method, which comprises: a step of receiving compressed data of a non-harmonic wave component including vector information indicative of a non-harmonic vector; a step of providing waveform data of a harmonic wave component to be generated simultaneously; a step of providing a non-harmonic vector; a step of selecting a non-harmonic vector on the basis of the compressed data of the non-harmonic wave component; a step of performing stretch/contraction control of a time-axial length of the selected non-harmonic vector in accordance with periodicity of the waveform data of the harmonic wave component; and a step of synthesizing waveform data of a non-harmonic wave component on the basis of the non-harmonic vector having been subjected to the stretch/contraction control by the step of controlling.

The arrangements allows a non-harmonic vector to be selected on the basis of compressed waveform data of a non-harmonic wave component, so that a waveform of a non-harmonic wave component can be reproduced/generated independently on the basis of the selected non-harmonic vector. At that time, stretch/contraction of the time-axial length of the selected non-harmonic vector is controlled in accordance with periodicity of waveform data of a harmonic wave component to be generated simultaneously, so that waveform data of a non-harmonic wave component are synthesized on the basis of the non-harmonic vector having been subjected to the stretch/contraction control. Such arrangements are advantageously applicable to the case where data compression of a non-harmonic wave component is performed by effecting a waveform division synchronized with periodicity of a corresponding harmonic wave component before vector quantization takes place, as noted earlier. In such a case, because the time-axial length of the non-harmonic vector is related to the periodicity of the corresponding harmonic wave component, appropriately controlling the time-axial length of the non-harmonic vector to stretch or contract in accordance with the periodicity of the harmonic wave component to be reproduced simultaneously will effectively facilitate reproduction of a timewise correspondence between the harmonic component waveform and non-harmonic component waveform of the original waveform, thereby contributing greatly to enhanced reproducibility of the non-harmonic component waveform. In this way, the waveform of the non-harmonic wave component can be reproduced/generated independently from the compressed data of the non-harmonic wave component. Also, mixing the thus-reproduced non-harmonic component waveform with the harmonic component waveform can reproduce the original waveform in an appropriate manner.

According to still another aspect of the present invention, there is provided a waveform compression method, which comprises: a step of providing separately a harmonic wave component and a non-harmonic wave component of waveform data to be compressed; a step of dividing the non-harmonic wave component into a plurality of sections on the basis of a waveform shape of the non-harmonic wave component; a step of providing a non-harmonic vector; and a step of generating compressed data of a non-harmonic wave component by vector-quantizing a non-harmonic wave component of each of the sections using the non-harmonic vector.

Waveform data to be compressed are separated, by means of an appropriate technique, into a harmonic (periodic) wave component and a non-harmonic (non-periodic) wave component and provided separately. According to the present invention, a vector quantization process is performed at least on the non-harmonic wave component. To vector-quantize a non-harmonic component waveform, it is desirable that the non-harmonic component waveform be divided into a plurality of sections and optimal vector quantization be performed for each of the thus-divided sections. As a preferred dividing technique, the present invention is arranged to divide the non-harmonic wave component into a plurality of sections on the basis of a waveform shape of the non-harmonic wave component. In this way, the non-harmonic wave component can be divided at appropriate locations which appear to provide a good data compressing efficiency and do not appear to substantially impair waveform reproducibility judging from the waveform shape of the non-harmonic wave component in question.

As with the above-discussed cases, it is preferable that the non-harmonic wave component be subjected to optimal vector quantization appropriate to characteristics or contents of the non-harmonic wave component in question, taking into account trade-off between promotion of data compression and waveform reproducibility. Although the non-harmonic wave component corresponds basically to a non-repetitive, random noise waveform, using a section division scheme considered optimal in view of its waveform shape and performing vector quantization based thereon will achieve efficient data compression and allow subsequent waveform generation processing to be performed with efficiency. For instance, for the above-mentioned "loop reproduction", a non-harmonic component waveform of a necessary time length may be reproduced by performing the vector quantization in such a manner to loop a specific representative vector, taking into consideration a degree of importance as to its shape and position within a predetermined sounding period, and then performing a loop reproduction process at the time of reproduction. Further, for the above-mentioned "one-shot reproduction", a given non-harmonic component waveform may be reproduced by performing the vector quantization in such a manner to use a representative vector of a necessary time length only once with no looping and then performing a reproduction process based thereon at the time of reproduction. In addition, as in the above-mentioned cases, a representative vector may be selected depending on a particular form or mode of non-harmonic wave component reproduction employed, such as the sequence reproduction or random sequence reproduction. Also, each of the representative vectors or non-harmonic vectors of the non-harmonic wave components can be shared between various different waveforms.

Namely, the present invention can highly facilitate analysis of a non-periodic component (non-harmonic wave component) waveform itself and vector quantization process on the non-periodic wave component independent of analysis of the periodic wave component which could not be readily conducted in the past. Further, because the vector quantization of the non-periodic wave component is performed on the basis of the peculiar non-harmonic wave component constituting the original waveform in conjunction with the harmonic wave component, the present invention can reproduce the non-periodic wave component with greatly increased accuracy or reproducibility. Thus, the present invention is intended to greatly facilitate the process to compress the non-harmonic wave component, so as to be very useful for realizing the vector quantization of the non-harmonic wave component. Further, with such arrangements, the present invention accomplishes various superior benefits; for example, it can highly contribute to an enhanced waveform compressing efficiency and also achieves superior reproducibility of the original waveform and, in particular, the non-harmonic wave component.

According to still another aspect of the present invention, there is provided a waveform generation method, which comprises: a step of providing waveform data of a harmonic wave component; a step of providing compressed data of non-harmonic wave components, respectively, for a plurality of sections, a step of providing a non-harmonic vector; and a step of selecting a non-harmonic vector on the basis of the compressed data of the non-harmonic wave component for each of the sections and generating waveform data of a non-harmonic wave component for each of the sections on the basis of the selected non-harmonic vector. In this waveform generation method, a waveform is generated by combining the waveform data of the harmonic wave component and the waveform data of the non-harmonic wave component. The waveform data for a given one of the sections include information indicating that no non-harmonic vector is to be used for the given section, so that waveform data of a harmonic wave component are generated for the given section without a non-harmonic wave component.

With the arrangements, the present invention can safely ignore a non-harmonic wave component present in such a section that is not so important in characterizing a sound, and thus can construct a reproduced waveform using only the harmonic wave component with the non-harmonic wave component muted or silenced for that section. Accordingly, it is possible to enhance the data compressing efficiency of the non-harmonic wave component.

According to still another aspect of the present invention, there is provided a waveform generation method, which comprises: a step of providing waveform data of a harmonic wave component; a step of providing compressed data of non-harmonic wave components, respectively, for a plurality of sections, a step of providing a non-harmonic vector; and a step of selecting a non-harmonic vector on the basis of the compressed data of the non-harmonic wave component for each of the sections and generating waveform data of a non-harmonic wave component for each of the sections on the basis of the selected non-harmonic vector. In this method, a waveform is generated by combining the waveform data of the harmonic wave component and the waveform data of the non-harmonic wave component. The waveform data for a given one of the sections include information indicating that the non-harmonic vector is to be used repetitively for the given section, so that waveform data of a harmonic wave component are generated for the given section by repeating the non-harmonic vector.

With the arrangements, the present invention reproduces, in a looping fashion, a non-harmonic wave component present in such a section that is not important in characterizing a sound, and accordingly, it is possible to enhance the data compressing efficiency of the non-harmonic wave component. For example, for a section having a relatively great sound volume in an original waveform, which is subject to a great influence of a harmonic component waveform, highly elaborate reproducibility is not required of a non-harmonic wave component and a waveform of the non-harmonic wave component can be reproduced/generated, without involving any significant problems, by just looping a non-harmonic vector of a limited data size. The inventive waveform generation method can be applied very advantageously to such a situation.

According to still another aspect of the present invention, there is provided a waveform generation method, which comprises: a step of providing waveform data of a harmonic wave component in correspondence with a rendition style designated from among a plurality of different rendition styles; a step of providing compressed data of a non-harmonic wave component in correspondence with the designated rendition style; a step of providing non-harmonic vectors via a memory storing a plurality of non-harmonic vectors; and a step of, on the basis of the compressed data of the non-harmonic wave component, selecting a non-harmonic vector from among the plurality of non-harmonic vectors provided via the memory and generating waveform data of a non-harmonic wave component on the basis of the selected non-harmonic vector. In the inventive tone generation method, a waveform corresponding to the designated rendition style is generated by combining the waveform data of the harmonic wave component and the waveform data of the non-harmonic wave component.

With the arrangements, the waveform of the non-harmonic wave component can be reproduced/generated independently from the compressed data of the harmonic wave component. Also, mixing the thus-reproduced non-harmonic component waveform with the harmonic component waveform can reproduce a unique original waveform corresponding to the designated rendition style.

The present invention may be constructed and implemented not only as a method invention as discussed above but also as an apparatus invention. Further, the present invention may be arranged and implemented as a program for causing a computer, microprocessor or the like to execute the inventive method, as well as a machine-readable storage medium storing such a program. Furthermore, the present invention may be implemented as a storage medium containing waveform data in a novel compressed data format. In addition, the hardware for use in implementing the present invention may comprise a functionally-fixed hardware device including a combination of discrete circuits, such as logic circuitry and gate array or an integrated circuit, without being necessarily limited to a programmable facility such as a computer or microprocessor. Stated differently, the processor in the inventive apparatus may be a non-programable processor or control unit only having a fixed processing function, not to mention a programmable processor such as a computer or microprocessor. Further, the electronic musical instrument embodying the present invention may be of any other type than the keyboard-based type. Furthermore, the waveform generation apparatus or music performance apparatus of the present invention may be a personal computer so programmed as to be capable of music performance, rather than being constructed as an electronic musical instrument. Moreover, the waveform generation apparatus or music performance apparatus of the present invention may be a karaoke apparatus, game apparatus, cellular (mobile) phone or any other type of multimedia equipment.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

Figure 1:
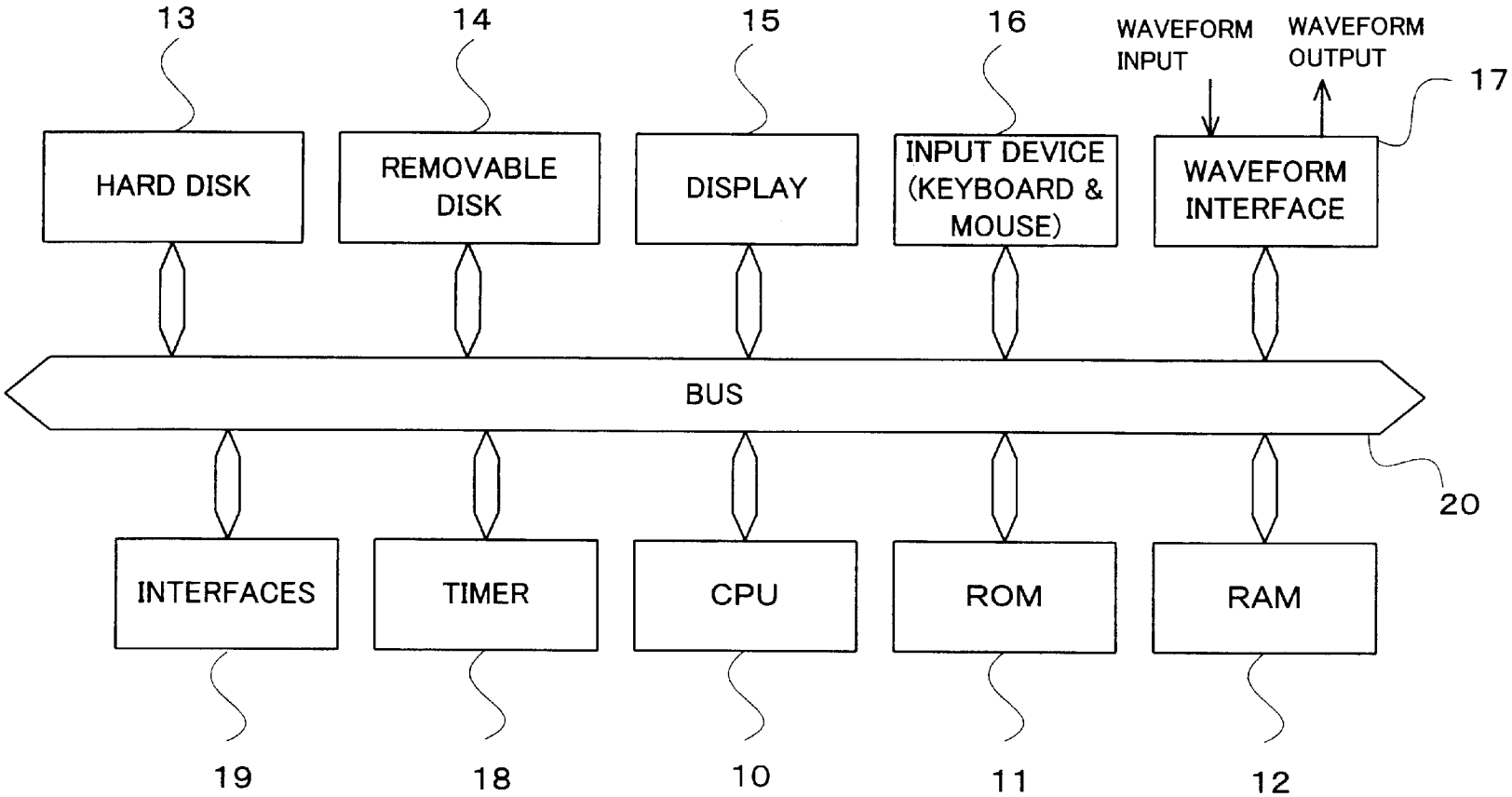
FIG. 1 is a block diagram outlining an exemplary hardware setup that is used to carry out a waveform compression method and a waveform generation method in accordance with preferred embodiments of the present invention.

First, with reference to FIG. 1, an example of a hardware setup will be outlined which is employed for carrying out a waveform compression method and waveform generation method in accordance with preferred embodiments of the present invention. The illustrated hardware setup is implemented using a general-purpose computer such as a personal computer, where predetermined waveform compression processing and waveform generation processing is performed by the computer executing predetermined programs (software) to carry out the inventive waveform compression method and waveform generation method. However, it should be obvious that the inventive waveform compression method and waveform generation method can also be implemented as microprograms processed by a DSP (Digital Signal Processor) rather than as the computer software. Further, these inventive methods may be implemented as a dedicated hardware apparatus including discrete circuits or integrated or large-scale integrated circuit, rather than as such programs. Furthermore, the apparatus of the invention may take the form of any other desired product than a general-purpose computer like a personal computer, such as an electronic musical instrument, karaoke apparatus, electronic game apparatus or other multimedia equipment.

In the hardware setup illustrated in FIG. 1, a CPU (Central Processing Unit) 10, functioning as a main control of the computer, is connected, via a CPU bus 20, a ROM (Read-Only Memory) 11, a RAM (Random Access Memory) 12, a hard disk device 13, a removable disk deice (such as a CD-ROM drive or a MO drive) 14, a display 15, an input device 16 such as a keyboard and a mouse, a waveform interface 17, a timer 18, interfaces 19 such as a MIDI (Musical Instrument Digital Interface), interface for a communication network, etc. The waveform interface 17 has a function of, in accordance with instructions from the CPU 10, sampling each analog waveform signal (audio signal) input via a microphone from the outside, converting the sampled analog waveform signal into digital representation, and then delivering the converted digital signal to the CPU bus 20. The waveform interface 17 also has a function of receiving, via the CPU 20, digital waveform data generated on the basis of compressed data through the waveform generation processing performed by the computer, converting the received digital waveform data into an analog waveform signal in accordance with a predetermined sampling frequency, and then outputting the converted analog waveform signal to a speaker system or the like.

Each digital waveform data received via the waveform interface 17 is temporarily written into a predetermined storage area of the RAM 12, hard disk device 13 or the like, on which the predetermined waveform compression processing of the present invention is performed under the control of the CPU 10. Each data compressed through the waveform compression processing is then stored into an compressed waveform database. In this case, digital waveform data, rather than analog waveform signals, may be received via the interface 19 or the like so that the received digital waveform data is subjected to given data compression. Note that the function of the waveform database may be performed by any type of data storage device; that is, any one of the RAM 12, hard disk device 13 and removable disk device 14 may be caused to function as the compressed waveform database. In general, the function of the compressed waveform database may be performed by an appropriate storage area of the hard disk device 13 of a large storage capacity or a removable storage medium, such as a CD-ROM or MO (Magneto-optical disk), detachably installable in the removable disk device 14. In an alternative, access may be made to a compressed waveform database provided in an external host computer or server computer via the interface 19 or communication line in order to write compressed data into the database, or compressed data necessary for tone reproduction may be downloaded to the hard disk device 13, RAM 12 and the like. When a waveform is to be generated, the compressed data stored in the compressed waveform database is used to carry out the predetermined waveform generation processing to generate digital waveform data. The thus-generated digital waveform data may be either output after being converted into analog data via the waveform interface 17 as noted earlier, or transferred in digital form to the outside via the interface 19 or the like. Note that in the case where the hard disk device 13, removable disk device 14 or external memory of the host computer, server computer or the like is employed as the compressed waveform database, the whole or part of the stored contents of the database may be transferred in advance into an internal transfer buffer (provided by the RAM 12 or the like) so that any designated waveform data set can be accessed promptly.

In response to various instructions from the CPU 10, the display 15 provides various graphic displays during the course of the waveform compression processing and waveform generation processing. The display 15 is used for a variety of purposes, which include graphically showing a shape of a recorded waveform, waveform editing condition during the waveform compression processing and control screens for setting, selecting, etc. various data such as tone color setting and editing data and system setting data. Further, using an alphanumeric keyboard and mouse as the input device 16, necessary control information and textual information is entered during the waveform compression processing and waveform generation processing. In addition, a MIDI keyboard module or sequencer (automatic performance device) or other computer is connected via the interface 19 with this computer, from which performance instruction information and the like for reproduction of tones are received and with which various data are exchanged.

The software programs for carrying out the waveform compression processing and/or waveform generation processing of the present invention under the control of the CPU 10 may be prestored in any one of the ROM 11, RAM 12, hard disk device 13, etc. Alternatively, these software programs may be prestored in a removable storage medium, such as a CD-ROM or MO, detachably installable in the removable disk device 14, or may be received from an external host computer or server computer via the interface 19 and communication line and then downloaded into the hard disk device 13 or RAM 12. Furthermore, in order to practice the present invention, the computer system as shown in FIG. 1 need not necessarily be equipped with the functions to perform both of the waveform compression processing and waveform generation processing and may be arranged to be able to perform only one of the two processing.

Figure 2:
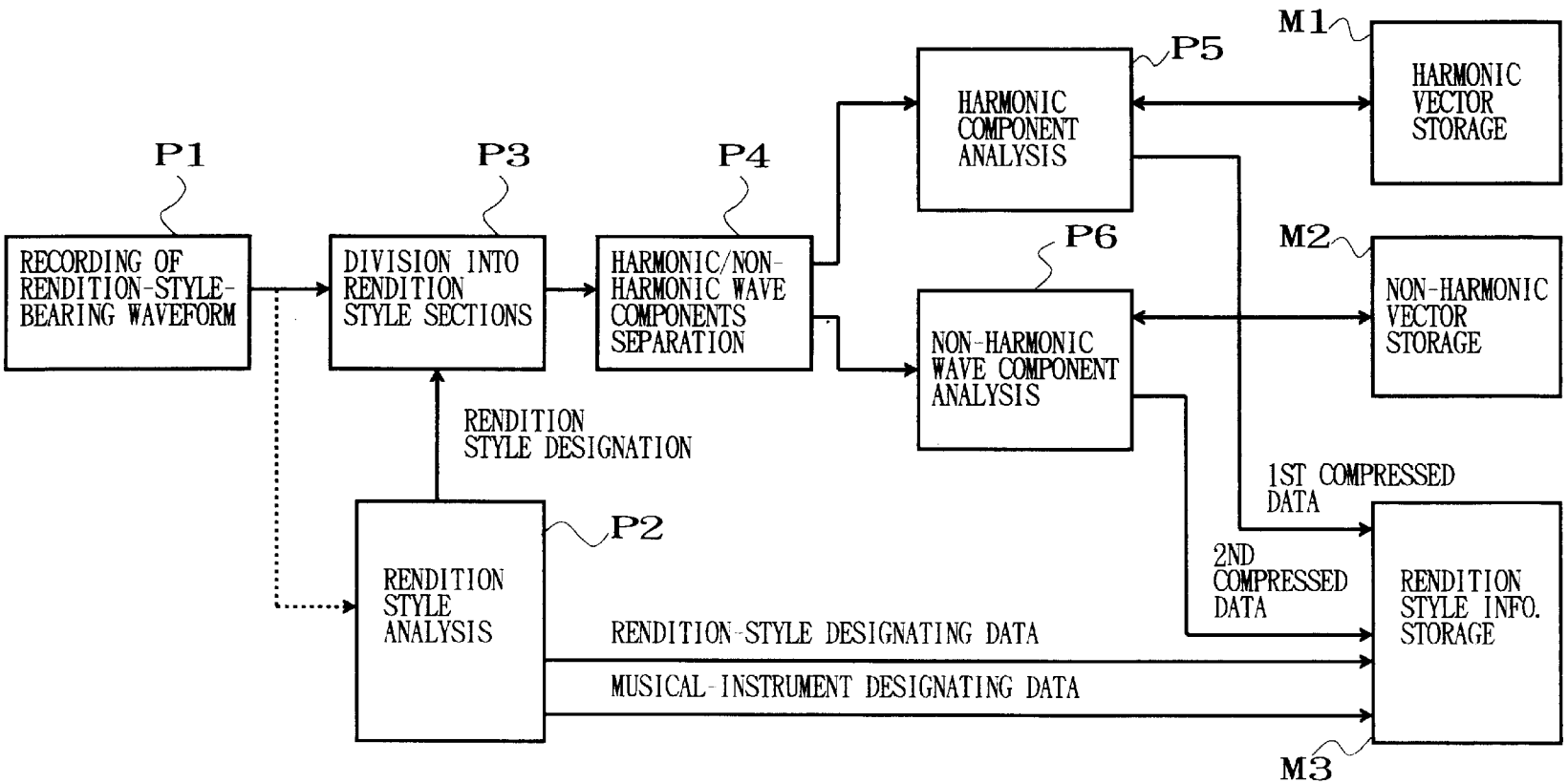
FIG. 2 is an equivalent block diagram illustrating an operational sequence of waveform compression processing carried out under the control of a CPU shown in FIG. 1.

Now, various processing will be described which are carried out under the control of the CPU 10. FIG. 2 is an equivalent block diagram illustrating an operational sequence of the waveform compression processing carried out under the control of the CPU 10.

First, in a "recording of rendition-style-bearing waveform" block (process P1), a tone of a same pitch and same intensity is actually performed on various natural musical instruments by skilled players using various rendition styles (i.e., performance styles), and individual performance tones thus produced with the various rendition styles are sampled via the waveform interface 17 and then recorded into a predetermined storage area of the RAM 12 or hard disk device 13. In this case, the performance tone to be recorded may be other than a single tone, such as a succession of performance tones (phrase), chord or the like, and this performance tone, such a single tone, phrase or the like, may contain a plurality of different rendition styles.

Note that waveform characteristics of the performance tone would differ for each musical instrument even when the performance tone is produced with a same rendition style such as "vibrato" or "slur". Further, even when there is employed a same rendition style and a same musical instrument, different waveform characteristics of the performance tone would be obtained for each different degree of the rendition style (e.g., for each different depth of vibrato). Thus, the "performance tones" based on the various rendition styles, which are to be recorded in this "recording of rendition-style-bearing waveform" (process P1), take into account or reflect differences in the rendition style according to such different viewpoints. Therefore, the "rendition-style-bearing performance tones" in this embodiment can be distinguished from each other or described, primarily by using combinations of three major factors: a "name of a musical instrument employed" (musical instrument name); a "name of a rendition style employed" (rendition style name); and "rendition style parameters" indicating a degree of the rendition style employed.

Among various examples of the parameters are:

Example 1: for "attack" (which is a rendition style name) of "violin" (which is a musical instrument name), the rising velocity, intensity, pitch, etc. of the attack are used as the rendition style parameters;

Example 2: for "slur" (rendition style name) of "violin" (musical instrument name), the width and velocity, intensity, pitch, etc. of the slur are used as the rendition style parameters;

Example 3: for "vibrato" (rendition style name) of "violin" (musical instrument name), the depth, velocity, intensity, pitch, etc. of the vibrato are used as the rendition style parameters;

Example 4: for "picking" (rendition style name) of "guitar" (musical instrument name), the intensity, pitch, etc. of the picking are used as the rendition style parameters;

Example 5: for "hammering-on (or hammer-on)" (rendition style name) of "guitar" (musical instrument name), the intensity, pitch, etc. of the hammering-on are used as the rendition style parameters;

Example 6: for "bend" (rendition style name) of "guitar" (musical instrument name), the width, velocity, intensity, pitch, etc. of the bend are used as the rendition style parameters; and Example 7: for "tremolo arm operation" (rendition style name) of "guitar" (musical instrument name), the width, velocity, intensity, pitch, etc. of the operation are used as the rendition style parameters.

Further, the rendition style parameters may include parameters representing timewise variations, such as time-varying curves in intensity, slur, etc.

In a next "rendition style analysis" block (process P2), each of the waveform data sets provided by the "recording of rendition-style-bearing waveform" process P1 is analyzed to detect each range within the waveform data set (representative of a single or a succession of performance tones) which corresponds to a same rendition style; such a "range" will hereinafter be called a "rendition style section". Then, for every one or plurality of rendition styles contained in the analyzed waveform data, a demarcating or dividing point at which the waveform data set is to be divided into rendition style sections is determined, and a rendition style name and rendition style parameters for describing the rendition style used in each of the rendition style sections are also determined, so as to generate rendition-style designating data made up of data indicating the rendition style name and the parameters. At the same time, musical-instrument designating data is also generated which is indicative of the musical instrument name pertaining to that rendition style. In this way, each waveform data set, representative of a single or a succession of performance tones, is divided into one or more rendition style sections according to one or more rendition styles used therein, and the three factors, "musical instrument name", "rendition style name" and "rendition style parameters" for describing the type of the rendition style in each of the divided rendition style sections are defined by the musical-instrument designating data and rendition-style designating data. These musical-instrument designating data and rendition-style designating data will be used as commentary and index information of compressed data that is produced, for that rendition style section, through waveform compressing processes P3 to P6.

As a typical example of an analyzing technique suitable for the "rendition style analysis" (process P2), any one of the following three may be used.

Example 1: A user actually listens to the performance tone of the waveform data set to be analyzed, the waveform of the performance tone is visually shown on the display 15 as necessary, and each dividing point where the waveform data set should be divided into a rendition style section is manually designated at the discretion of the user using the input device 16. Further, the rendition style name and parameters for each of the user-designated rendition style sections are determined at the discretion of the user and manually designated using the input device 16. These operations constitute a manual rendition style analysis.

Example 2: The CPU 10 executes a predetermined rendition-style analyzing program to identify a pitch of the waveform data set to be analyzed and analyze variations in various tonal characteristics such as the amplitude. Then, on the basis of the identified and analyzed results, the CPU 10 automatically determines each dividing point where the waveform data set should be divided into a rendition style section, as well as the rendition style name and parameters for each of the thus-determined rendition style sections. These operations constitute an automatic rendition style analysis.

Example 3: This example is a combination of Example 1 and Example 2 mentioned above. Namely, the manual analysis by the user and the automatic analysis by the CPU are carried out in combination for analyzing rendition styles. For example, the division of the waveform data set into one or more rendition styles and determination of the rendition style name or names are performed manually by the user, but the rendition style parameters for each of the rendition style sections are determined through the automatic analysis' by the CPU. In a modification, the dividing point, name or parameters of each of the rendition style sections having been determined through the automatic analysis by the CPU may be modified as appropriate through user's manual operation.

Then, in a "division into rendition style sections" block (process P3), each of the waveform data sets, which is representative of a single or a succession of performance tones and which has been provided by the "recording of rendition-style-bearing waveform" process P1, is actually divided in accordance with the dividing-point designating information determined in the "rendition style analysis" process P2. Process P4 to process P6 following this process P3 are each performed on the waveform data of each one of the divided rendition style sections.

In a next "harmonic/non-harmonic wave components separation" process P4, the waveform data of each of the rendition style sections divided by the "division into rendition style sections" process P3 are read out from memory, such as the RAM 12, and then subjected to a process where the waveform data are separated into harmonic and non-harmonic wave components. In a typical example of this separation process, the waveform data to be separated are first input and subjected to a frequency (spectrum) analysis based on the fast Fourier transform (FFT) so as to extract a fundamental-pitch frequency component and harmonic components of the waveform data. Then, a waveform of the harmonic wave component (harmonic component waveform) is generated by performing the inverse Fourier transform on the extracted harmonic wave component, and a waveform of a non-harmonic wave component (non-harmonic component waveform) is generated, as a residual waveform obtained by subtracting the harmonic component waveform from the input waveform data to be separated. As an example, in the above-mentioned FFT process, there may be used a window function of a length equal to eight periods (corresponding to eight cycles) of the waveform data to be analyzed, and the entire waveform data may be analyzed with the window function shifted by a frame equal to one eighths of the period. The use of this FFT-based analysis can analyze frequency fluctuations of the harmonic components (this term should not be confused with the term "harmonic wave component" as previously noted) as just fluctuations and can extract these fluctuations as contained in the harmonic wave component. Of course, the window function can be set to any desired size and shift amount than the above-mentioned as long as fluctuations in frequency and level of the frequency components to be analyzed by the FFT process can be detected as just fluctuations under the settings of the size and shift amount of the window function.

Then, in a "harmonic wave component analysis" block (process P5), characteristics of the waveform data corresponding to the harmonic wave components separated/generated by the "harmonic/non-harmonic wave components separation" process P4 are analyzed, so that an optimal vector quantization process is performed in accordance with the analyzed characteristics to thereby generate compressed data of the harmonic component waveform compressed in accordance with the vector quantization. Here, because the harmonic wave component, in principle, can be regarded as a repetitive waveform, the harmonic component waveform can be reproduced such as by looping a particular single- or plural-cycle waveform as a representative vector (or looping two successive representative vectors in a cross-fading fashion). Thus, such representative vectors may be prestored in a harmonic vector storage section M1 as harmonic vectors in such a manner that the "harmonic wave component analysis" process P5 can generate, as the compressed data, data that include vector information designating a specific harmonic vector, from among the harmonic vectors stored in the harmonic vector storage section M1, to be used as the representative vector of the harmonic wave component and other information describing how the designated harmonic vector, i.e., representative vector, is to be used (e.g., a section and time period over which the vector is to be used and looped and a form of an envelope to be imparted to the vector). Specific example of the "harmonic wave component analysis" process P5 will be later described in more detail.

In a "non-harmonic wave component analysis" block (process P6), on the other hand, an analysis is performed on characteristics of the waveform data corresponding to the non-harmonic wave component separated by the "harmonic/non-harmonic wave components separation" process P4, so that an optimal vector quantization process is performed on the non-harmonic wave component in accordance with the analyzed characteristics to thereby produce compressed data of the non-harmonic component waveform compressed in accordance with the vector quantization. In the described embodiment, the non-harmonic wave component is subjected to vector quantization in an optimal form appropriate to the characteristics or contents of the non-harmonic wave component in question, taking into account trade-off between promotion of data compression and waveform reproducibility. Although the non-harmonic wave component corresponds basically to a non-repetitive, random noise waveform, a non-harmonic component waveform of a necessary time length may be reproduced by looping a given representative vector taking into consideration a degree of importance as to its contents and position within a sounding period (this form or mode of reproduction operation is called "loop reproduction"), or by using a representative vector of a necessary time length only once with no looping (this reproduction operation is called "one-shot reproduction"). In an alternative, a given non-harmonic component waveform may be reproduced by combining two or more representative vectors while switching between the combinations of the vectors in a predetermined order or sequence (this reproduction operation is called "sequence reproduction"), or the order to switch between the combinations may be set randomly so as to emphasize noise or random characteristics of the non-harmonic wave component (this reproduction operation is called "random sequence reproduction"). As mentioned above, it is preferable to use, as non-harmonic vectors, representative vectors appropriate to such various optimal forms of the vector quantization. Thus, it is preferable that such various representative vectors be prestored, as non-harmonic vectors, in a non-harmonic vector storage section M2 in such a way that the "non-harmonic wave component analysis" process P6 can generate, as the compressed data, data that include vector information designating a specific non-harmonic vector, from among the non-harmonic vectors stored in the non-harmonic vector storage section M2, suitable for use as the representative vector of the non-harmonic wave component and other information describing how the designated harmonic vector, i.e., representative vector, is to be used (e.g., a section where the vector is to be used, a distinction between the loop reproduction, the one-shot reproduction and the like, a period over which the vector is to be used and a form of an envelope to be imparted to the vector). Specific example of the "non-harmonic wave component analysis" process P6 will also be later described in more detail.

In FIG. 2, a rendition-style information storage section M3 stores, as rendition style information, the compressed data (first compressed data) generated by the "harmonic wave component analysis" process P5 and compressed data (second compressed data) generated by the "non-harmonic wave component analysis" process P6 for each of the rendition style sections, in combination with the musical-instrument designating data and rendition-style designating data generated by the "division into rendition style sections" process P3 for that rendition style sections. Therefore, for waveform reproduction purposes, the compressed data of the harmonic and non-harmonic wave components (i.e., first and second compressed data) for each rendition style section in question can be read out from the rendition-style information storage section M3 using, as indices, the musical-instrument designating data and rendition-style designating data for a desired rendition style. Then, predetermined harmonic and non-harmonic vectors can be read out from the harmonic and non-harmonic vector storage sections M1 and M2, respectively, in accordance with the vector information included in the read-out compressed data, and an original waveform or a tone waveform having the characteristics of the original waveform can be reproduced or formed by reproducing the harmonic and non-harmonic component waveforms and additively synthesizing these reproduced harmonic and non-harmonic waveforms.

Figure 3:
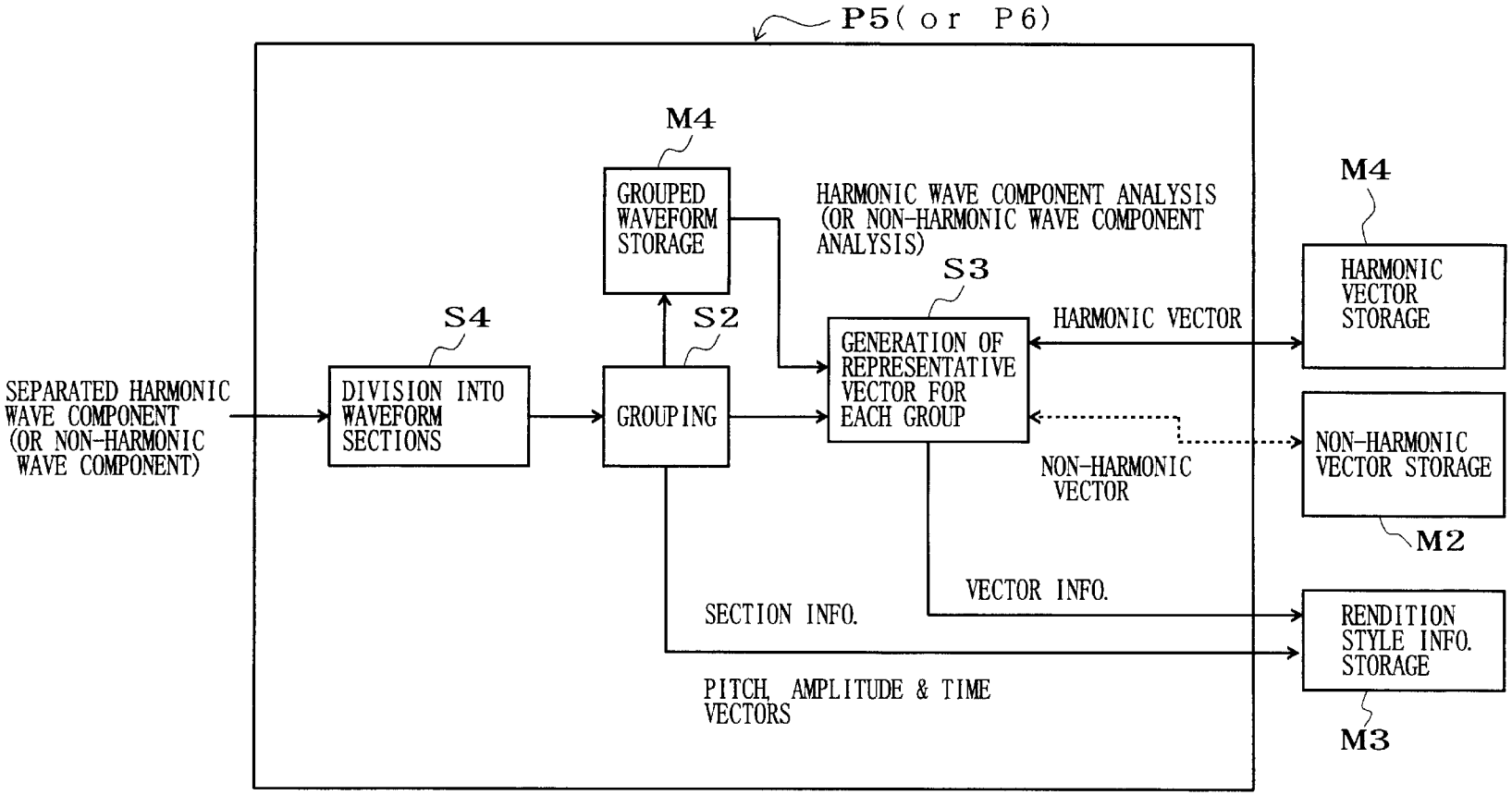
FIG. 3 is an equivalent block diagram showing a specific example of a "harmonic wave component analysis" process shown in FIG. 2.

The following paragraphs describe in greater detail the "harmonic wave component analysis" process P5, with reference to FIG. 3. Note that FIG. 3 does not show the whole of the "harmonic wave component analysis" process P5, and it only shows a part of the process P5 pertaining to operations of newly generating harmonic vectors and accumulatively storing them into the harmonic vector storage section M1.

First, in a "division into waveform sections" operation S1 of FIG. 3, the harmonic component waveform of a given rendition style section, generated by the "harmonic/non-harmonic wave components separation" process P4, is divided into a plurality of waveform sections. For this purpose, a continuous waveform section of one or more cycles, where a commonality or similarity is found in per-cycle waveform shape characteristics, is extracted as a division of the waveform. Therefore, the individual divided waveform sections would generally differ in size, i.e., occur at non-uniform intervals. Further, in this "division into waveform sections" operation S1, the user may designate, through manual operation, appropriate dividing points while viewing the shape of the waveform shown on the display 15. Alternatively, such dividing points may be automatically determined by the CPU 10 executing a predetermined waveform division program to automatically analyze frequency characteristics of each of the waveform cycles. In another alternative, the user's manual operation and the automatic operation may be performed in combination. As a result of the "division into waveform sections" operation S1, "waveform section information" is generated as information descriptive of how the input harmonic component waveform has been divided into a plurality of the waveform sections. Note that to efficiently determine presence of the commonality or similarity in per-cycle waveform shape characteristics, it is preferable that the waveform be extracted on a cycle-by-cycle basis and normalization be performed to uniformize (make equal) respective pitches and amplitude levels of the individual waveform cycles so that a comparison can be made purely between the per-cycle waveform shapes. Because, in such a case, the vector quantization will be subsequently performed on the waveform data with the normalized pitch and amplitude, it is preferable to generate a "pitch vector" and "amplitude vector" as vectors that indicate variations over time from the original pitches and amplitude levels to the normalized pitch and amplitude level. It may sometimes be desirable to perform the normalization with a time-axial position of the waveform data controlled appropriately, in which case a "time vector" is also generated to indicate variations over time of the time-axial position of the waveform data.

In a next "grouping" operation S2, the waveform data of the individual divided waveform sections are grouped in such a manner that waveform data of every waveform sections having a similarity in waveform shape of one or more cycles are classified into a same group. Whereas this grouping is of course performed among the waveform sections in the rendition style section in question, it is especially intended to be performed among the waveform sections of different rendition style sections (including different musical instruments). Namely, the waveform data of a great number of the harmonic and non-harmonic waveform sections for each already grouped rendition section are stored, in a grouped state, into a grouped waveform storage section M4. Further, in the "grouping" operation S2, it is ascertained, for the waveform data of each of the currently divided waveform sections, whether or not the waveform data of these waveform sections, detected as having a similarity in waveform shape of one or more cycles, correspond to any one of the groups already stored in the grouped waveform storage section M4. If answered in the affirmative, the waveform data of these waveform sections detected as having the similarity are incorporated into the corresponding group. Namely, the waveform data of the waveform sections detected as having the similarity are stored into an area of the grouped waveform storage section M4 dedicated to that group, and "group information" indicating the group is also generated. If, however, there is no corresponding waveform in the already stored groups, the waveform data of the waveform sections are stored as a new group; namely, the waveform data of the waveform sections detected as having the similarity are stored into an area of the grouped waveform storage section M4 dedicated to that new group, and "group information" indicating the group is generated. In this case, for an enhanced data sharing efficiency, an appropriate waveform normalization process may be performed to uniformize (make equal) respective pitches and amplitude levels of the original waveform, as previously noted, so that the grouping is performed through a comparison purely between the waveform shapes. It should be obvious that the comparison is made, without regard to the size of each of the waveform sections, between the single- or plural-cycle waveform shapes characterizing the waveform section. Thus, as long as some of the waveform sections are found similar in waveform shape, the waveform data of these waveform sections will be classified into a same group even though the waveform data of these waveform sections are of different musical instruments, different rendition styles, different pitches or the like. This means that each of the harmonic vectors stored in the harmonic vector storage section M1 (similarly, each of the non-harmonic vectors stored in the non-harmonic vector storage section M2) can be shared between rendition style sections of difference characteristics, such as different musical instruments, different rendition styles and different pitches and that the above-described arrangement is useful for reducing the storage size of the harmonic vector storage section M1 or non-harmonic vector storage section M2. Note that the "grouping" operation S2 may be performed through user's manual operation or through automatic processing by the CPU 10, or through a combination of the user's manual operation and automatic processing.

Next, in a "group-by-group representative vector generation" operation S3, a representative vector of the waveform data within a same group is generated with reference to the stored contents of the grouped waveform storage section M4, taking into consideration of characteristics of the individual waveform data. In a case where a similar single- or plural-cycle waveform is repeated in a waveform section, that waveform is temporarily determined as a provisional representative vector, and then an average, mean or most characteristic vector, of the provisional representative vectors of the individual waveform data within the same group, is determined and actually generated. The thus-generated representative vector (stated more specifically, single- or plural-cycle waveform data) is stored into the harmonic vector storage section M1 for registration as a harmonic vector. Also, "vector information" for the harmonic component is generated to indicate which one of the harmonic vectors stored in the storage section M1 the representative vector of the group in question corresponds to. Specifically, because this "vector information" is index data indicating which one of the harmonic vectors (single- or plural-cycle waveform data) stored in the storage section M1 is to be used as the representative vector, it is only small-size data made up of a plurality of bits.

The "vector information" is stored into the rendition-style information storage section M3, as compressed data of the harmonic wave component within the waveform section in question in combination with "section information" generated by the "division into waveform sections" operation S1. Therefore, the compressed data of the harmonic wave component (first compressed data) pertaining to each rendition style section include a combination of "vector information" and "section information" for each of a plurality of waveform sections divided from the rendition style section. In the case where the vector quantization process has been performed on the waveform data normalized in pitch and amplitude level, the above-mentioned "vector information" and "section information" is stored into the rendition-style information storage section M3 in further combination with the "pitch vector" and "amplitude vector" generated by the "division into waveform sections" operation S1. Further, in the situation where the vector quantization process has been performed on the waveform data normalized not only in pitch and amplitude level but also in time-axial position of the waveform data, the above-mentioned "vector information" and "section information" is stored into the rendition-style information storage section M3 in further combination with the "pitch vector", "amplitude vector" and "time vector" generated by the "division into waveform sections" operation S1.

The following paragraphs describe a specific example of the above-mentioned "harmonic wave component analysis" process P5 performed in a situation where a relatively great number of the harmonic vectors have been accumulated in the harmonic vector storage section M1. This example of the harmonic wave component analysis is directed primarily to searching through all the harmonic vectors accumulated in the harmonic vector storage section M1 in order to find a harmonic vector capable of being suitably used as a representative vector of the harmonic component waveform, and then selecting the thus-found (searched-for) harmonic vector as a representative vector of the harmonic wave component in question.

For example, a waveform of each cycle is first extracted from the harmonic component waveform of each rendition style section separated/generated through the "harmonic/non-harmonic wave components separation" process P4, and a normalization process is performed to uniformize respective pitches and amplitude levels of the individual extracted waveforms; if necessary, a further normalization process is performed to control and uniformize time-axial positions of the waveform data. Then, the thus-normalized waveform data are compared, for every single or plural cycles, to the many harmonic vectors already accumulated in the harmonic vector storage section M1, to search for or find a harmonic vector similar to the normalized waveform data. In this case too, the search is conducted not only through the harmonic vectors corresponding to the same natural musical instrument and/or same rendition style as for the harmonic component waveform to be analyzed but also through the harmonic vectors corresponding to other natural musical instruments and/or other rendition styles. Once such a similar harmonic vector has been found, a continuous single- or plural-cycle section analogous to the thus-found harmonic vector is extracted as a single waveform section to generate "section information" and "vector information" designating the searched-for harmonic vector as a representative vector of the waveform section. These generated information is stored in combination into the rendition-style information storage section M3. Similarly to the above-mentioned, in the situation where the vector quantization process has been performed on the waveform data normalized in pitch and amplitude level, a "pitch vector" and "amplitude vector", which indicate variations over time from the original pitches and amplitude levels to the normalized pitch and amplitude level, are stored into the rendition-style information storage section M3 in further combination with the above-mentioned "vector information" and "section information". In the situation where the vector quantization process has been performed on the waveform data normalized not only in pitch and amplitude level but also in time-axial position of the waveform data, the "vector information" and "section information" is stored into the rendition-style information storage section M3 in further combination with the "pitch vector", "amplitude vector" and "time vector" indicative of variations over time in time-axial position of the waveform data.

If the result of the search has shown that no similar harmonic vector is present in the harmonic vector storage section M1, operations similar to the operations S1, S2 and S3 of FIG. 3 are carried out to perform a waveform division and grouping so as to generate a new representative vector, and the thus-generated representative vector is registered into the harmonic vector storage section M1 as a new harmonic vector. Then, "vector information" designating this new harmonic vector is generated and stored into the rendition-style information storage section M3 in combination with the "section information".

Figure 4:
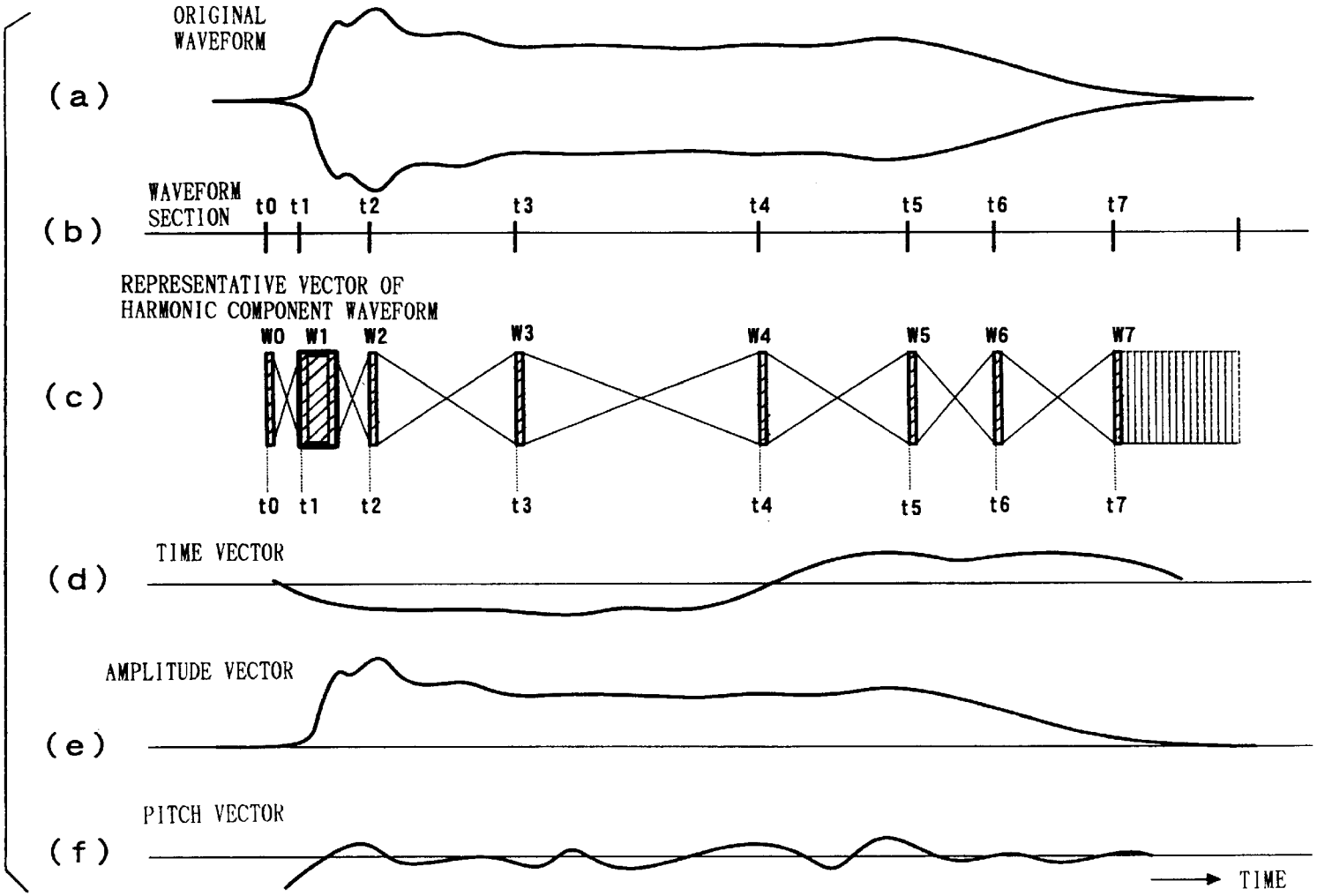
FIG. 4 is a graph showing an exemplary manner in which vector quantization is performed on a waveform of a harmonic component.

FIG. 4 is a graph showing an exemplary manner in which vector quantization is performed on a harmonic component waveform. Part (a) of FIG. 4 schematically shows an example of an original waveform by its amplitude envelope. Part (b) of FIG. 4 shows an exemplary manner in which a harmonic component waveform separated from the original waveform is divided into a plurality of waveform sections, by a diagram illustrating boundaries between the waveform sections. Part (c) of FIG. 4 shows a situation where appropriate harmonic vectors W0, W1, W2, . . . , W7, comprising single- or plural-cycle waveform data, have been selected as representative vectors of the individual waveform sections, and is explanatory of exemplary loop reproduction of a waveform. For instance, harmonic vector W0 is used as a representative vector of the waveform section from time point t0 to time point t1, and this vector is reproduced between the time points t0 and t1 in a looping fashion (loop-reproduced) at the time of waveform reproduction. In the illustrated example of part (c), cross-fading loop reproduction is performed between the representative vector and a representative vector of the next waveform section (in this case, a waveform in a leading segment of harmonic vector W1). Harmonic vector W1 having a relatively great size (i.e., composed of a multi-cycle waveform) is used as a representative vector of the waveform section from time point t1 to time point t2, and this vector is reproduced only once in a predetermined leading portion of the time period between time point t1 to time point t2 and then loop-reproduced in the remaining portion of the time period (e.g., cross-fading loop reproduction is performed between the waveform of a trailing end portion of harmonic vector W1 and following harmonic vector W2). Further, harmonic vector W2 is used as a representative vector of the waveform section from time point t2 to time point t3, and this vector is loop-reproduced at the time of waveform reproduction (e.g., cross-fading loop reproduction is performed between harmonic vectors W2 and W3). The same is true with the following waveform sections, except that in the waveform section beginning at time point t7, harmonic vector W8 is used as a representative vector and reproduced in a simple looping fashion at the time of waveform reproduction. Parts (d), (e) and (f) of FIG. 4 show examples of "time vector", "amplitude vector" and "pitch vector", respectively, extracted from the harmonic component waveform shown in part (a).

Now, a description will be made about a specific example of the above-mentioned "non-harmonic wave component analysis" process P6. Basically, this "non-harmonic wave component analysis" process P6 may be carried out using substantially the same procedural steps as the "harmonic wave component analysis" process P5 shown in FIG. 3. However, because the object to be analyzed here is a non-harmonic component waveform of a single rendition style section separated/generated through the "harmonic/non-harmonic wave components separation" process P4, it should be obvious that the concept of "single cycle" or "plural cycle" of a non-harmonic component waveform to be analyzed itself does not apply to the "division into waveform sections" operation (S1), "grouping" operation (S2) and "group-by-group representative vector generation" operation (S3). Further, it should also be obvious that in a case where a representative vector of a non-harmonic component waveform is newly generated by the "group-by-group representative vector generation" operation (S3) using the non-harmonic vector storage section M2 rather than the harmonic vector storage section M1, the newly-generated representative vector is stored and registered into the non-harmonic vector storage section M2 as a new non-harmonic vector.

In this "non-harmonic wave component analysis", a "waveform division" operation similar to the operation S1 of FIG. 3 is carried out so as to perform a vector quantization process on each divided waveform section. In this case, division of the non-harmonic component waveform into a plurality of waveform sections, in general, may be based on a technique of dividing, into waveform sections, every portion having a commonality or similarity in characteristics or assumed to have such a commonality or similarity; however, this embodiment proposes to perform either one or both of the following two techniques.

The first proposed technique is to divide a non-harmonic component waveform into a plurality of waveform sections for a time period corresponding to an integral multiple or fractional multiple of a period (cycle) of a harmonic wave component within a same rendition style section, utilizing periodicity of the harmonic wave component. Of course, in this instance too, the divided waveform sections need not be at equal intervals and may have different lengths as appropriate; for example, one of the divided waveform sections may have a length corresponding to two cycles of the harmonic wave component, another one of the divided waveform sections may have a length corresponding to ten cycles of the harmonic wave component, and so on. Such an technique of dividing the non-harmonic component waveform on the basis of the periodicity of the harmonic wave component allows the non-harmonic component waveform to be automatically divided into waveform sections without requiring much human labor and thereby affords a benefit of significantly facilitating the necessary analyzing operations. Further, in a situation where the character of the non-harmonic component waveform depends more or less on the periodicity of the harmonic wave component, the technique allows an appropriate waveform division to be performed with great facility. Even where the non-harmonic component waveform is divided on the basis of the periodicity of the harmonic wave component as mentioned, a specific form of the division of the non-harmonic wave component certainly differs from a specific form of the division of the harmonic wave component, and therefore it should be obvious that the harmonic wave component and non-harmonic wave component are divided into waveform sections independently of each other.

The second proposed technique is to individually search for a portion having a commonality or similarity in characteristics of a non-harmonic component waveform and divide that portion into a plurality of waveform sections. This technique is suitable for use in such a case where relatively important portions of a non-harmonic component waveform are extracted to select/generate a corresponding representative vector, i.e., a non-harmonic vector. This second dividing technique is also suitable for use in another case where a representative vector, i.e., a non-harmonic vector, is selected/generated by extracting not-so-important portions of a non-harmonic component waveform to omit the not-so-important portions and thereby enhance a data compressing efficiency. Further, the second dividing technique is also suitable for use in still another case where the data compression is to be promoted by loop-reproducing a non-harmonic vector, because it permits selection of any section suitable for the looping. Each of the above-mentioned first and second dividing techniques may be implemented through user's manual operation or automatic processing by the CPU 10, and the manual operation and automatic processing may be performed in combination as appropriate.

The described embodiment of the present invention is arranged such that contents of the representative-vector selecting/generating process to be performed for subsequent waveform sections would more or less vary depending on which of the first and second dividing techniques is employed to divide the non-harmonic component waveform into waveform sections. Such arrangements will be described in greater detail below with reference to several flow charts.

FIG. 5 is a flow chart showing a specific example of the "non-harmonic wave component analysis" process P6 in relation to a case where a non-harmonic component waveform is divided into waveform sections in accordance with the above-mentioned first dividing technique and a process to compress data of the non-harmonic wave component (vector quantization process) is performed on the basis of the waveform division. Further, FIG. 6 is a flow chart showing another specific example of the "non-harmonic wave component analysis" process P6 in relation to a case where a non-harmonic component waveform is divided into waveform sections in accordance with the above-mentioned second dividing technique and a process to compress data of the non-harmonic wave component (vector quantization process) is performed on the basis of the waveform division.

Figure 5A:
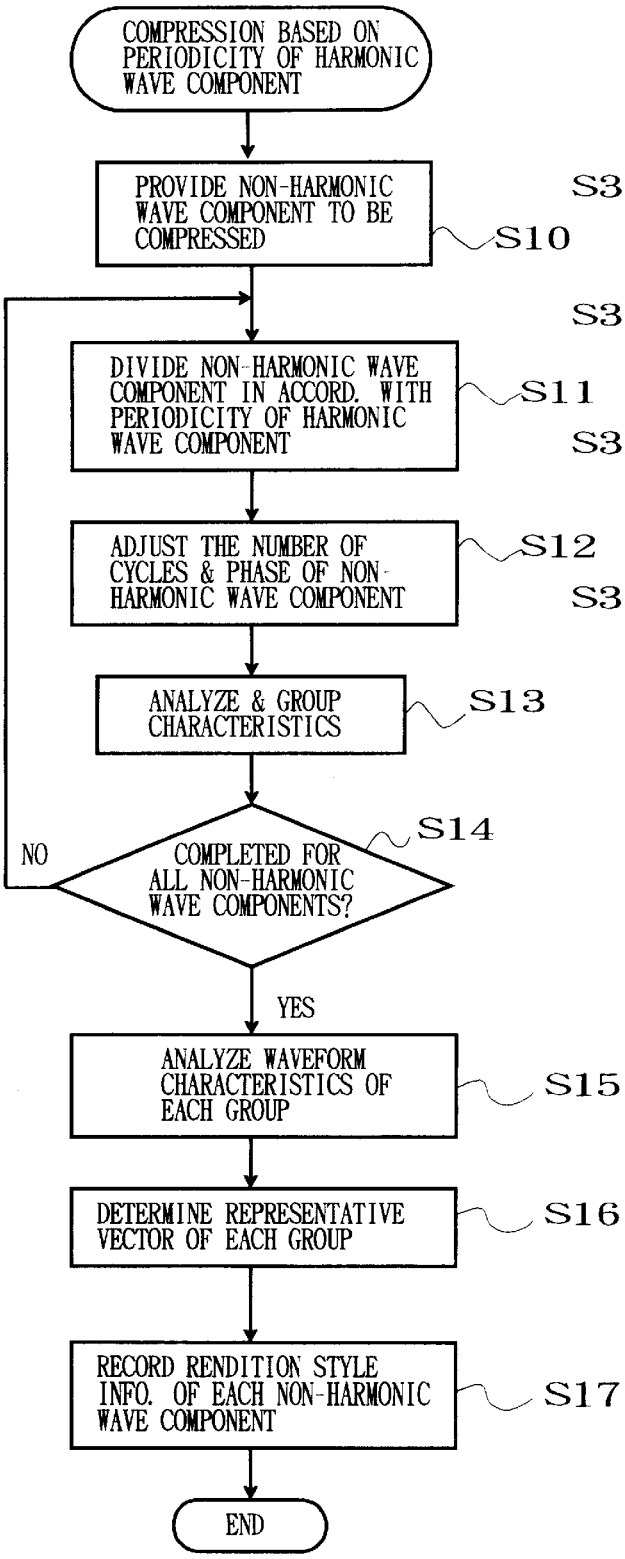
FIGS. 5A and 5B are flow charts showing a specific example of the "non-harmonic wave component analysis" process of FIG. 2 where a non-harmonic component waveform is divided into a plurality of waveform sections utilizing periodicity of a harmonic wave component and analyzed for each of the divided sections.
Figure 6:
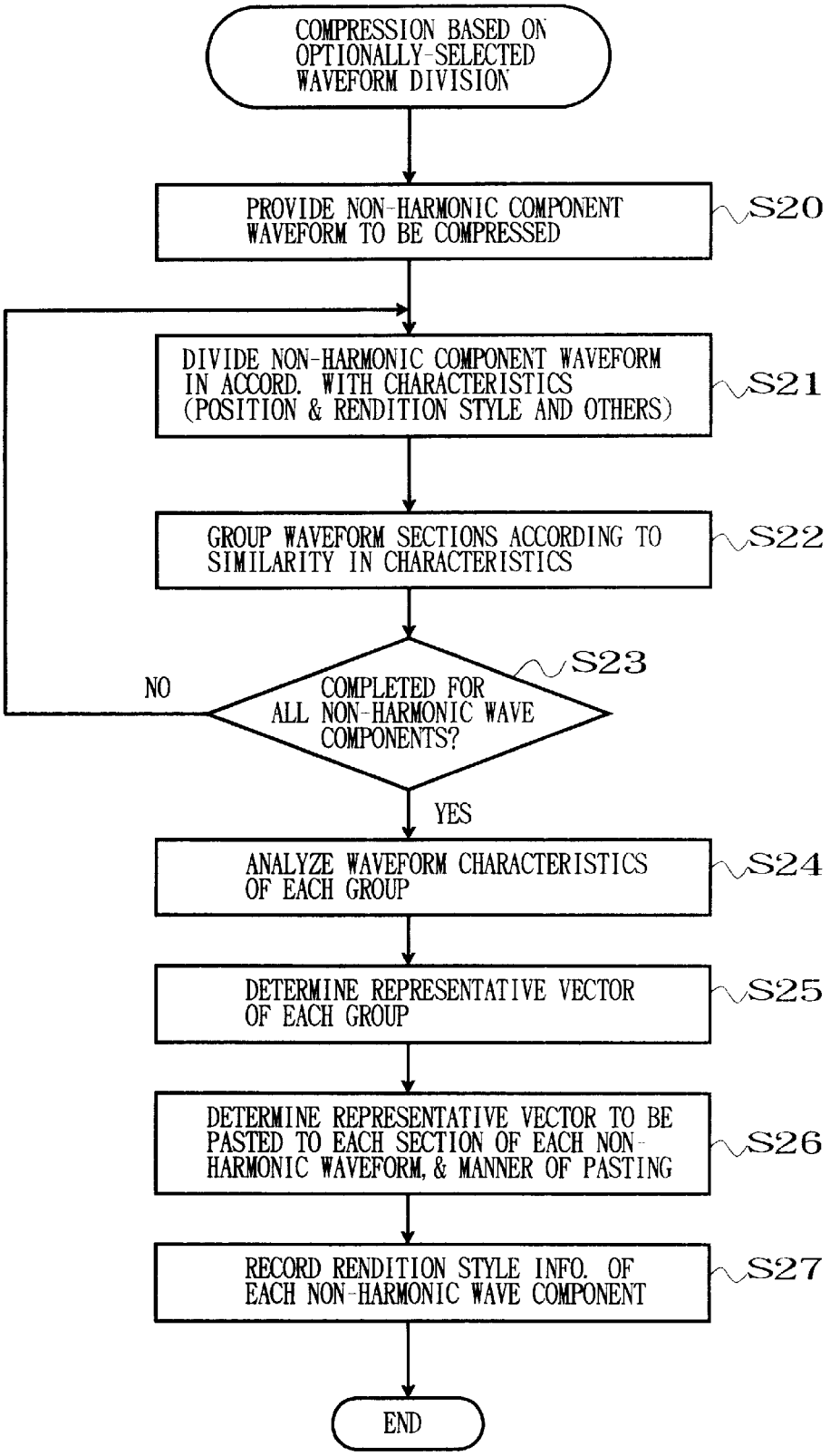
FIG. 6 is a flow chart showing another specific example of the "non-harmonic wave component analysis" process of FIG. 2 where a non-harmonic component waveform is divided into a plurality of waveform sections on the basis of characteristics of the non-harmonic component waveform and analyzed for each of the divided sections.

Referring first to the flow chart of FIG. 5A, a non-harmonic component waveform to be compressed is provided at step S10.

Then, at next step S11, the non-harmonic component waveform is divided into a plurality of waveform sections in accordance with a period or cycle length of a harmonic wave component corresponding to the non-harmonic component waveform, i.e., in synchronism with periodicity of the corresponding harmonic component waveform. Here, the non-harmonic component waveform is divided into a plurality of waveform sections for a time period corresponding to an integral multiple or fractional multiple of the period of the harmonic wave component, i.e., in appropriate synchronism with the periodicity of the harmonic component waveform, as previously mentioned. The divided waveform sections need not be at equal intervals and may have different lengths as appropriate; for example, one of the divided waveform sections may have a length corresponding to half the cycle of the harmonic wave component, another one of the divided waveform sections may have a length corresponding to eight cycles of the harmonic wave component, and so on.

At following step S12, the respective positions of the divided waveform sections produced at the preceding step are adjusted as appropriate. For instance, the non-harmonic component waveform is divided temporarily at uniform reference intervals, such as every predetermined number of cycles of the harmonic wave component at step S11, and then at following step S12, the user makes changes to increase or decrease the length of a particular one of the waveform sections to correspond to a certain number of the harmonic wave component's cycles and/or slightly shift a particular one of the dividing point so that the phase of the non-harmonic component waveform at the divided point is changed to a more appropriate phase such as a zero-cross phase. Such adjustment or changes may be performed through automatic processing based on a predetermined changing program rather than through user's manual operation, or through a combination of the automatic processing and user's manual operation.

Figure 5B:
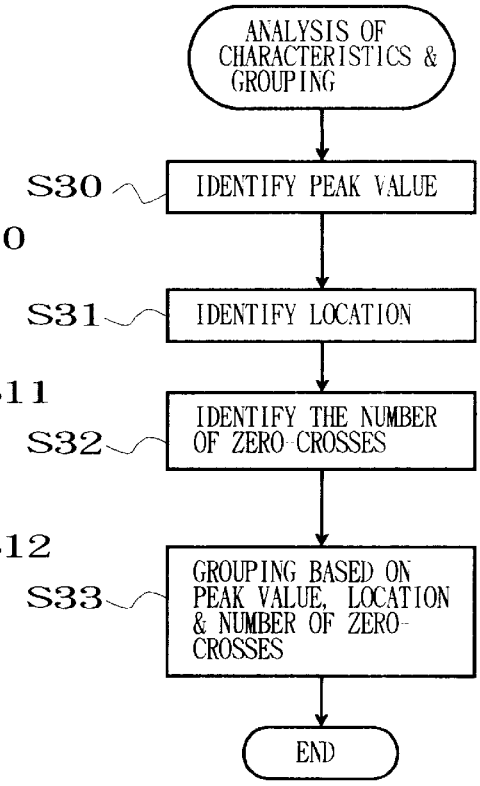

Next, at step S13, characteristics, in the individual divided waveform sections, of the non-harmonic component waveform are analyzed and grouped. This grouping, similarly to the "grouping" operation S2 of FIG. 3, is also performed across different rendition style sections (different musical instruments as well) and assumed to promote sharing of a representative vector, namely, a non-harmonic vector. In FIG. 5B, there is shown a more detailed flow chart of the analysis of the non-harmonic component waveform characteristics and grouping operation carried out at step S13.

In a "peak value analysis" of step S30, an analysis is made to locate a peak level, in the divided waveform section in question, of the non-harmonic component waveform (i.e., noise-like waveform). In a "location analysis" of step S31, a further analysis is made to identify a particular segment (e.g., former half, middle or latter half) of a single- or predetermined plural-cycle section) of a harmonic wave component corresponding to the waveform section which the location of the peak level, in the divided waveform section in question, of the non-harmonic component waveform corresponds to. In a "number of zero-cross analysis" of following step S32, an analysis is made to determine the number of times the amplitude, in the divided waveform section, of the non-harmonic component waveform passes through the zero level. The number of zero-crosses thus determined permits intensity of noise-like variations to be analyzed appropriately. At next step S33, the divided waveform section of the non-harmonic component waveform is classified into a given group on the basis of the analysis results of steps S30 to S32 above. Because the waveform to be grouped here is a non-harmonic component waveform that does not itself have periodicity, the described embodiment is arranged to permit some measuring evaluations for the grouping, by performing special analyses, such as the ones of steps S30 to S32, and using these analyzed results as conditions or standards for the grouping. The conditions or evaluation standards for grouping this type of non-harmonic component waveform may include, in place of or in addition to those used at steps S30 to S32, a d.c. offset level, the number of sign inversions in waveform differentiation values of the waveform section in question (which can also be an index to intensity of noise-like variations) and the like as appropriate. Further, an optionally-selected number of conditions and evaluation standards may be selected from among these conditions and evaluation standards and the three conditions or evaluation standards used at steps S30 to S32 above, and the thus-selected conditions and evaluation standards may be used in combination. It is preferable that the respective operations of the individual steps in FIG. 6 be carried out in an interactive manner in response to user's manual operation, although they may of course be implemented through fully automatic processing based on a predetermined program or through a combination of the manual operation and automatic processing.

Referring back to FIG. 5A, it is checked at step S14 whether or not the operations of steps S11–S13, i.e., the waveform division and grouping operations, have been completed for all non-harmonic component waveforms that are to be subjected to the data compression process in the current processing routine. If answered in the negative, the routine reverts to step S11, where the above-mentioned operations of steps S11–S13 are performed on a next non-harmonic component waveform. Once the waveform division and grouping operations have been completed for all the non-harmonic component waveforms, the routine proceeds to step S15 in order to analyze characteristics of each of the waveform groups, such as amplitude envelope characteristics of each of the waveforms in the individual groups. At next step S16, a representative vector of the waveform group is determined using the analyzed result of step S15. For instance, a particular waveform, having an average of the amplitude envelope characteristics of the individual waveforms in the group, may be determined as the representative vector. Alternatively, a particular waveform, having an average of the frequency characteristics, numbers of zero-crosses or amplitude level distributions of the individual waveforms in the group, may be determined as the representative vector. In another alternative, the representative vector may be selected or determined on condition that it is an average of or suitable for representing the individual waveforms in the group with respect to one or more of the amplitude envelope characteristics, frequency characteristics, numbers of zero-crosses, amplitude level distributions or other appropriate characteristics. After that, the thus-determined representative vector of the waveform group is stored into the non-harmonic vector storage section M2 as a non-harmonic vector. In this way, the respective representative vectors of the individual waveform groups are stored and registered into the non-harmonic vector storage section M2 as non-harmonic vectors. Here, let it be assumed that the non-harmonic vectors stored in the non-harmonic vector storage section M2 are normalized in their amplitude levels and the amplitude envelope of the non-harmonic component waveform in each of the corresponding waveform sections is extracted as an "amplitude vector". However, the non-harmonic vectors stored in the non-harmonic vector storage section M2 need not necessarily be normalized in their amplitude levels, in which case low-level data will be stored just as they are (without normalization) but limited memory bits are allocated to low-level portions to thereby permit efficient use of a memory storage space. In the case where the non-harmonic vectors stored in the non-harmonic vector storage section M2 are not normalized in their amplitude levels, a difference between the amplitude envelope of the non-harmonic vector and the amplitude envelope of the non-harmonic component waveform in each of the waveform sections may be extracted as the "amplitude vector".

At next step S17, rendition style information of the individual non-harmonic wave components (which includes "section information", "vector information" designating a non-harmonic vector as a representative vector, "amplitude level", etc. of the individual waveform sections) is stored into the rendition-style information storage section M3. In this case, it is also assumed that other information indicating a frequency of a harmonic wave component corresponding to the non-harmonic vector, i.e., representative vector, and the like is also stored as the "section information". With this arrangement, a same or common non-harmonic vector can be used for harmonic wave components of different pitches, provided that there is a similarity or commonality in the waveform shape of the non-harmonic wave component. Of course, the non-harmonic vectors stored in the non-harmonic vector storage section M2 can be shared among a variety of cases similarly to or more appropriately than the harmonic vectors. For example, a same or common non-harmonic vector can be used for different waveform sections in a same rendition style section (sections having different time-axial positions within a same non-harmonic component waveform), as well as for non-harmonic component waveforms of different instrument tones or different rendition style sections.

Next, the embodiment of FIG. 6 will be described.

First, at step S20, a non-harmonic component waveform to be compressed is provided.

At next step S21, characteristics of individual portions of the non-harmonic component waveform to be compressed are observed and analyzed, and the waveform is segmented at points corresponding to boundaries between the respective partial characteristics and thereby divided into a plurality of waveform sections. In this case, the partial characteristics of the non-harmonic component waveform are analyzed taking into consideration positions, rendition styles, shapes or other characteristics of the waveform. For example, as the positions, "attack" (rising portion of a sound), "body" (steady portion of a sound), "joint" (portion of a sound connecting to another sound), release (attenuating or falling portion of a sound) and the like are considered. The rendition styles are considered in relation to the individual positions; for example, a "fluctuating" rendition style, "noise-containing" rendition style, etc. are considered for the "attack" position, a "vibrato" rendition style, "tremolo" rendition style, etc. are considered for the "body" position, a "slur" rendition style, "glissando" rendition style, "bend" rendition style, etc. are considered for the "joint" position, and a "mute" rendition style, "sustain" rendition style, etc. are considered for the "release" position. Further, as the waveform shape characteristics, a variety of factors may be considered, such as an amplitude envelope shape (e.g., effective and peak amplitude values), number of zero-crosses or intervals between the zero-crosses, number of peaks or intervals between the peaks, locations of the peaks, distribution of the peak levels.

At following step S22, the non-harmonic component waveform sections are grouped according to similarity in the characteristics, on the basis of the characteristics of the non-harmonic component waveform in the individual divided waveform sections. The similarity in the characteristics of the non-harmonic component waveform may be determined in accordance with any appropriate standard, such as by visually observing the waveform shown on the display and/or by sounding and aurally ascertaining the non-harmonic component waveform in the waveform section in question. Similarly to the above-mentioned, this grouping is performed across different rendition style sections (different musical instruments as well) and assumed to promote sharing of a representative vector, namely, a non-harmonic vector.

Then, it is checked at step S23 whether or not the operations of steps S21 and S22, i.e., the waveform division and grouping operations, have been completed for all non-harmonic component waveforms that are to be subjected to the data compression process in the current processing routine. If answered in the negative, the routine reverts to step S21, where the above-mentioned operations of steps S21 and S22 are performed on a next non-harmonic component waveform. Once the waveform division and grouping operations have been completed for all the non-harmonic component waveforms, the routine proceeds to step S24 in order to analyze various characteristics of each of the waveform groups, such as amplitude envelope characteristics of each of the waveforms in the group.

At next step S25, a representative vector of the waveform group in question is determined using the analyzed result of step S24. In this way, the respective representative vectors of the individual waveform groups are stored and registered into the non-harmonic vector storage section M2 as non-harmonic vectors. As previously mentioned, the non-harmonic vectors stored in the non-harmonic vector storage section M2 may or may not be normalized in their amplitude levels as desired. The described embodiment is arranged to employ, as a way to compress a non-harmonic component waveform, any one of various different techniques as follows, and is assumed to determine a representative vector in accordance with an appropriate standard selected depending on which of the compression techniques is employed.

Example 1 of Compression: Representative vector of a predetermined time length is reproduced once and thereby compression is performed to cover a waveform section in question. This form of compression corresponds to the above-mentioned "one-shot reproduction". For example, a representative vector of a waveform section in such a region where even the shape of non-harmonic component waveforms changes sharply may be determined to suit this Example 1 of Compression.

Example 2 of Compression: Representative vector of a relatively short time length is reproduced repetitively (i.e., loop-reproduced) and thereby compression is performed to cover a waveform section in question. This form of compression corresponds to the above-mentioned "loop reproduction". Note that a plurality of representative vectors for looping may be combined in a predetermined sequence so that the combination can be used for the above-mentioned "sequence reproduction". Alternatively, a plurality of representative vectors for looping may be combined in a random sequence so that the combination can be used for the above-mentioned "random sequence reproduction". For example, a representative vector of a waveform section in such a region where the amplitude level decreases simply or remains constant may be determined to suit this Example 2 of Compression.

Example 3 of Compression: Non-harmonic component waveforms in a not-so-important region may be omitted partly. For a waveform section where such omission is made, there arises no need to select a representative vector.

Following step S26 of FIG. 6 determines, for each waveform section of each non-harmonic component waveform, a particular non-harmonic vector to be used as a representative vector at the time of reproduction and a manner in which the non-harmonic vector thus determined is to be pasted. This determination also depends on which of the above-mentioned examples of compression techniques is employed. Manner of pasting the non-harmonic vector is described as non-harmonic wave component reproduction mode information (or as "pasting information") indicating which of the following reproduction modes is to be employed.

One-shot Reproduction: As mentioned above, a single representative vector suiting Example 1 of Compression is used, and the non-harmonic component waveform of the waveform section in question is reproduced by pasting (reproducing) the one representative vector once.

Sequence Reproduction: As mentioned above, a plurality of representative vectors suiting Example 2 of Compression are used, and the non-harmonic component waveform of the waveform section in question is reproduced by pasting (reproducing) these representative vectors in a predetermined sequence.

Random Sequence Reproduction: As mentioned above, a plurality of representative vectors suiting Example 2 of Compression are used, and the non-harmonic component waveform of the waveform section in question is reproduced by pasting (reproducing) these representative vectors in a random sequence.

Loop Reproduction: As mentioned above, a single representative vector suiting Example 2 of Compression is used, and the non-harmonic component waveform of the waveform section in question is reproduced by pasting (reproducing) the single representative vector in a repetitive fashion. This loop reproduction may be combined with the sequence reproduction or random sequence reproduction.

Alternate Loop Reproduction: A single representative vector suiting Example 2 of Compression is used, and the non-harmonic component waveform of the waveform section in question is reproduced by repetitively pasting (reproducing) the single representative vector while alternately reversing the direction of the representative vector. This alternate reproduction may be combined with the sequence reproduction or random sequence reproduction.

Delete Reproduction: This reproduction mode corresponds to Example 3 of Compression mentioned above. In this mode, no representative vector is used, and non-harmonic component waveforms in the waveform section in question are deleted to thereby leave only harmonic component waveforms in that region. However, only a part, rather than the whole, of the waveform section in question may be placed in the delete reproduction mode, in which case a representative vector is determined for the remaining region as appropriate.

At next step S27, rendition style information of the individual non-harmonic wave components (which includes "section information", "vector information" designating a non-harmonic vector as a representative vector, "pasting information", "amplitude level", etc. of the individual waveform sections) is stored into the rendition-style information storage section M3.

Note that the various non-harmonic wave component reproduction modes mentioned above are also applicable to the case where the "non-harmonic wave component analysis" process has been performed in accordance with the above-mentioned first dividing technique, rather than only to the case where the "non-harmonic wave component analysis" process has been performed in accordance with the above-mentioned second dividing technique.

Figure 7:
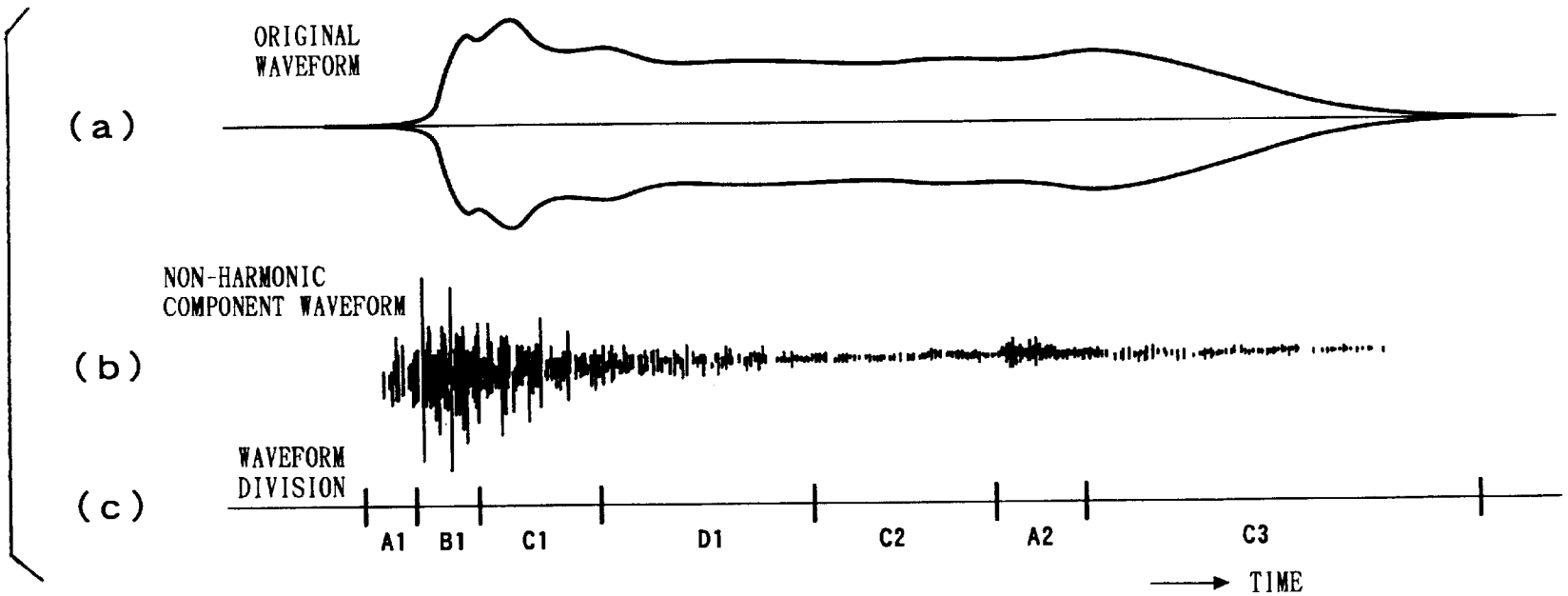
FIG. 7 is a graph showing an exemplary manner in which vector quantization is performed on a non-harmonic component waveform.

FIG. 7 is a graph showing an exemplary manner in which vector quantization is performed on a non-harmonic component waveform. More specifically, part (a) of FIG. 7, which is similar to part (a) of FIG. 4, schematically shows an example of an original waveform by its amplitude envelope. Part (b) of FIG. 7 shows an example of a non-harmonic component waveform separated from the original waveform. Part (c) of FIG. 7 shows the non-harmonic component waveform of part (b) which are divided into a plurality of waveform sections A1, B1, C1, D1, C2, A2 and C3, by a diagram illustrating boundaries between the waveform sections. In the illustrated example, waveform sections A1 and A2 are where the one-shot reproduction is applied by setting the waveform sections in accordance with the second dividing technique. Waveform section B1 is where a representative vector has been determined in synchronism with the periodicity of the harmonic wave component in accordance with the first dividing technique. In this waveform section B1, either the one-shot reproduction or the loop reproduction may be employed. Waveform sections C1, C2 and C3 are sections corresponding to the loop reproduction. Further, waveform section D1 is a section corresponding to the delete reproduction.

Other specific examples of vector quantization of a non-harmonic component waveform are shown in FIGS. 8–13. Upper parts (a) of FIGS. 8–10 and 13 each show an example of an original waveform from which a non-harmonic component waveform is separated, while parts (b) of these figures each show an example of a waveform obtained by vector-quantizing and reproducing the original waveform in accordance with the various techniques.

Figure 8:
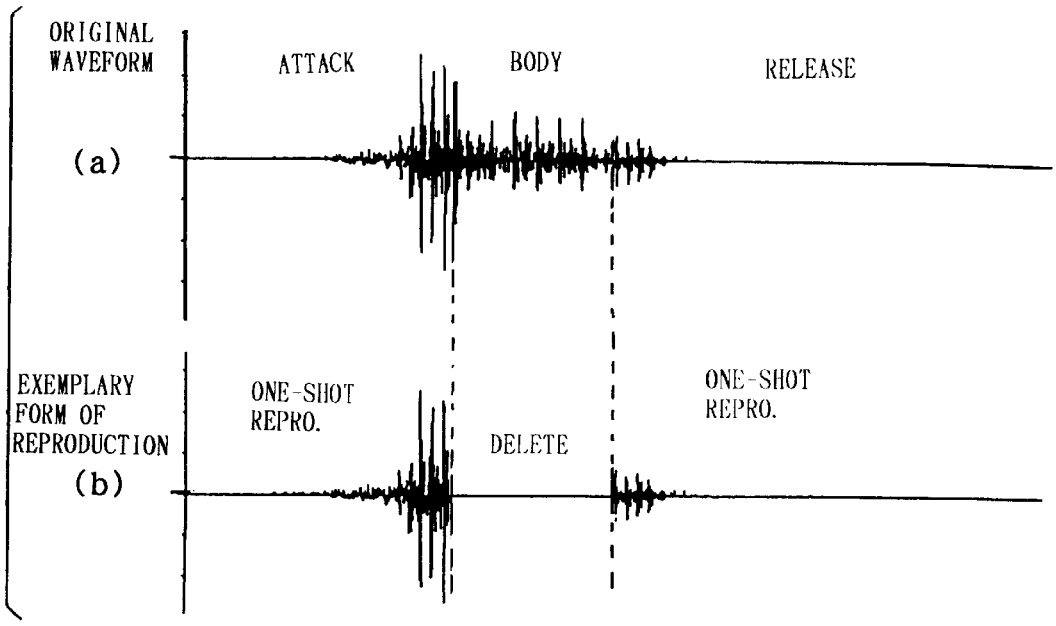
FIG. 8 is a graph showing another example of the vector quantization performed on a non-harmonic component waveform.

More specifically, FIG. 8 shows an example of compression where the original waveform is divided into three sections, "attack", "body" and "release", appropriate representative vectors are determined for the "attack" and "release" sections as corresponding to the one-shot reproduction and the non-harmonic component waveform is cut out of the "body" section as corresponding to the delete reproduction. By actually listening to a reproduced tone based on this compression, one may recognize that the non-harmonic component waveform without a steady tone-color-stable portion (i.e., "body" section) does not give a strong abnormal or unnatural feeling provided that it has the "attack" and "release" sections.

Figure 9:
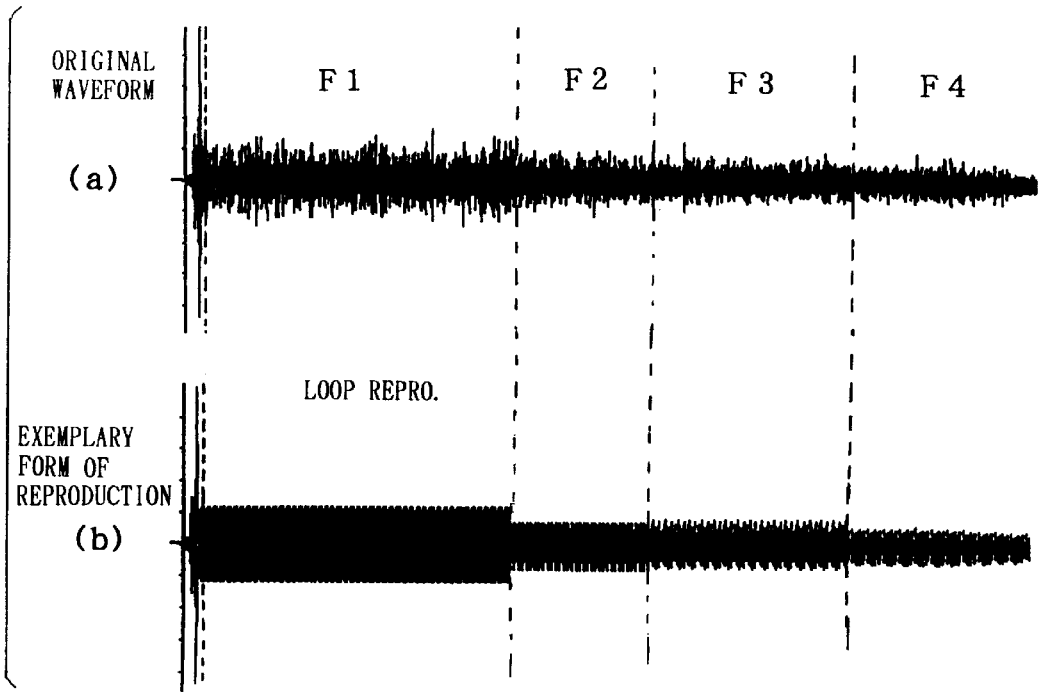
FIG. 9 is a graph showing still another example of the vector quantization performed on a non-harmonic component waveform.

FIG. 9 shows another example of compression where the non-harmonic component waveform is divided into four sections F1–F4 and representative vectors of predetermined sizes are determined for the respective divided sections and reproduced in a looped fashion. Although even a non-harmonic wave component may yield certain periodicity through looping of its representative vector, mixing the non-harmonic wave component with a reproduced harmonic component waveform may eliminate an abnormal or unnatural feeling because the non-harmonic wave component is at a very low level.

Figure 10:
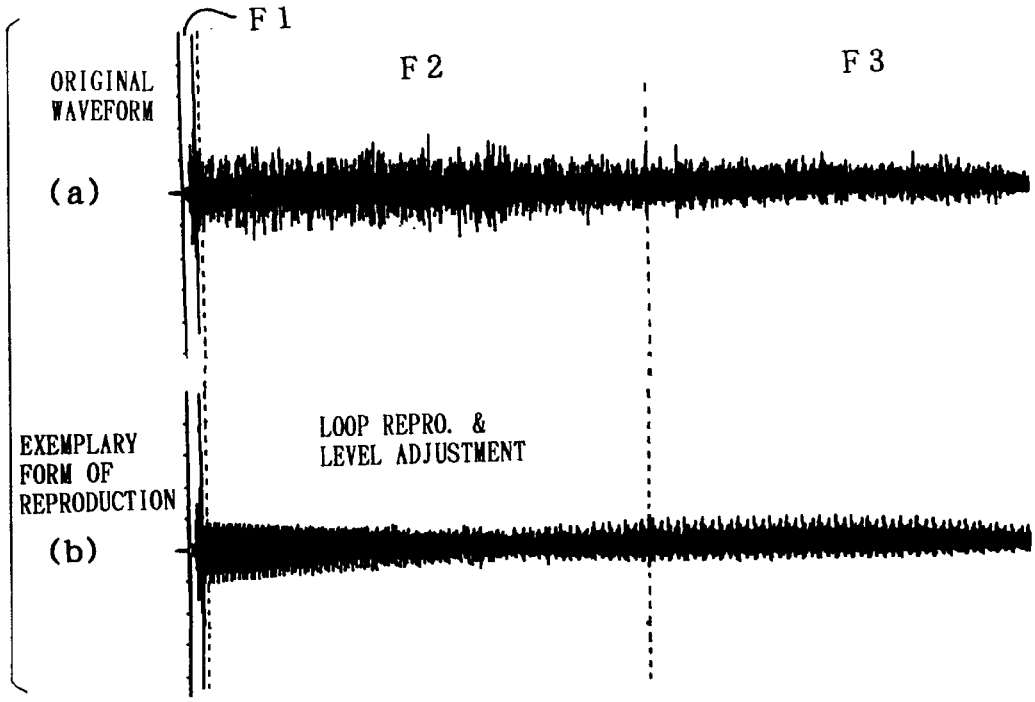
FIG. 10 is a graph showing still another example of the vector quantization performed on a non-harmonic component waveform.

FIG. 10 shows still another example of compression where the non-harmonic component waveform is divided into three sections F1, F2 and F3, the original waveform is used just as it is for the first divided section F1 rich in variations, and representative vectors of predetermined sizes are determined for the succeeding two divided sections F2 and F3 and reproduced in a looped fashion. Further, in this example, the representative vectors of the succeeding divided sections F2 and F3 have been subjected to considerable variations in their respective amplitude envelopes. Thus imparting appropriate amplitude envelopes to the loop-reproduced waveform can give a feeling similar to that of the original waveform.

Figures 11A, 11B, 11C:
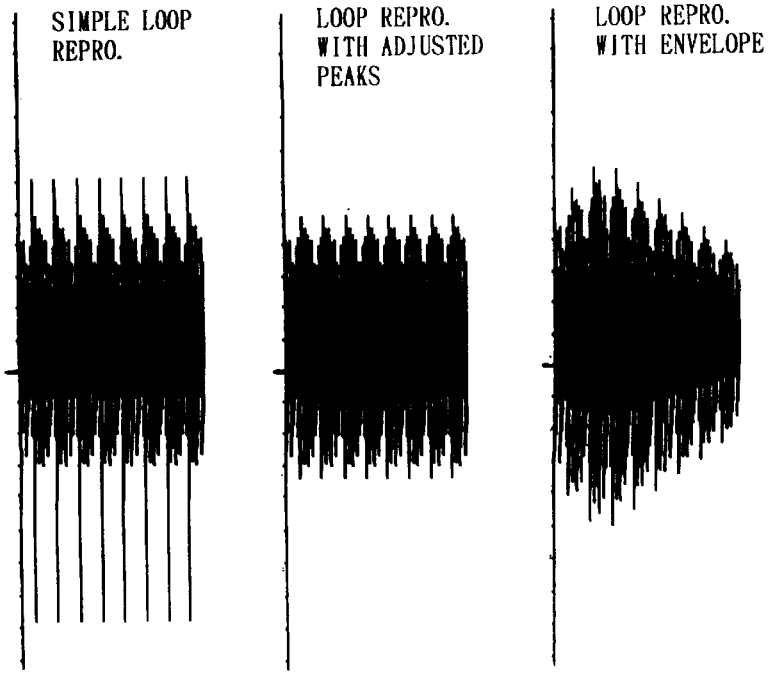
FIGS. 11A–11C are graphs showing yet another example of the vector quantization performed on a non-harmonic component waveform.

FIGS. 11A to 11C shows examples of level control performed in the described embodiment. More specifically, FIG. 11A shows an example of simple loop reproduction with no level control. FIG. 11B shows an example of peak-modified loop reproduction where the peak level of a representative vector to be looped is attenuated to provide weakened periodicity. Further, FIG. 11C shows another example where amplitude envelope variations are further imparted to the reproduced example to further weaken the periodicity. Thus, combining the loop reproduction with the level control can yield very advantageous results.

Figure 12:
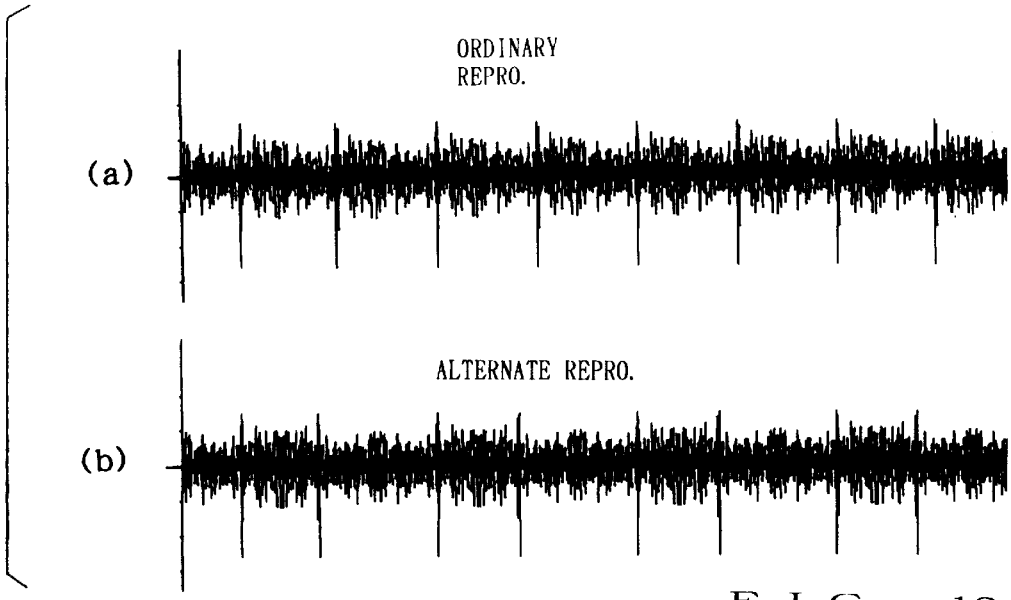
FIG. 12 is a graph showing yet another example of the vector quantization performed on a non-harmonic component waveform.

Part (a) of FIG. 12 shows an example of ordinary loop reproduction, and part (b) of FIG. 12 shows an example of alternate loop reproduction. As may be readily understood from the figure, the alternate loop reproduction has periodicity longer than that of the ordinary loop reproduction, and thus the representative vector size may be reduced further, which would contribute further to efficient waveform compression.

Figure 13:
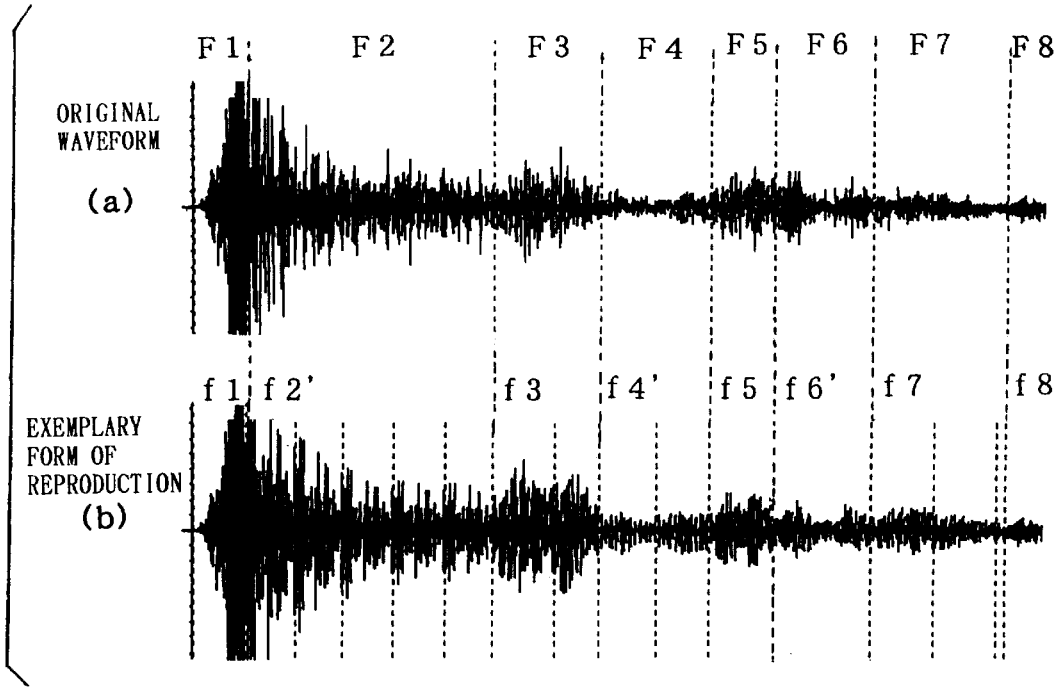
FIG. 13 is a graph showing yet another example of the vector quantization performed on a non-harmonic component waveform.

FIG. 13 shows still another example of compression where the non-harmonic component waveform is divided into eight sections F1–F8, and where waveform reproduction is conducted using representative vectors (non-harmonic vectors) f1, f3, f5, f7 and f8, extracted from the original waveform, for the attack section F1, vibrato-containing sections F3, F5 and F7 and release section F8 and using non-harmonic vectors f2', f4' and f6', extracted from another original waveform, as representative vectors for the other sections F2, F4 and F6. In each of the sections, any appropriate one of the one-shot reproduction mode, loop reproduction mode, etc. is employed. In one example implementation, the non-harmonic vector f2 extracted from the other original waveform is used as a representative vector for the body section F2, which is loop-reproduced with an appropriate envelope imparted thereto to approach the original waveform (see part (a) of FIG. 13). For other sections F4 and F6 as well, the non-harmonic vectors f4' and f6', extracted from the other original waveform, are imparted with appropriate envelopes and loop-reproduced as necessary, to thereby reproduce/generate non-harmonic component waveforms approximate to the original waveform (see part (a) of FIG. 13). Namely, same non-harmonic vectors can be used with respect to a plurality of different original waveforms. In such a case, non-harmonic component waveforms most suitable for the respective original waveforms can be reproduced/generated by appropriately controlling the manner of performing various processing (e.g., incorporating, into compressed data, data describing an appropriate manner of performing reproduction such as amplitude vector and/or pasting information).

Now, a description will be made about an embodiment of tone generation processing which is carried out by use of compressed data of harmonic and non-harmonic components having been provided in the above-mentioned manner.

Figure 14:
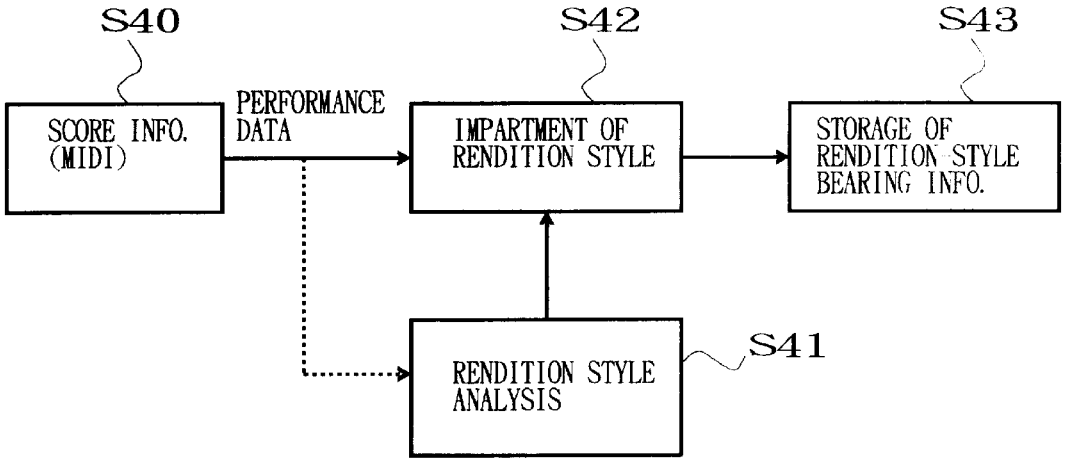
FIG. 14 is an equivalent block diagram showing an example of a process for preparing a rendition-style-bearing music staff.

FIG. 14 is a functional block diagram showing an example of processing which is directed to preparing a rendition-style-bearing music score such that compressed data of harmonic and non-harmonic wave components in a multiplicity of rendition style waveforms having been produced in the above-mentioned manner can be used to a sufficient degree in performance of a desired music piece. First, at step S40, music score information (e.g., performance data in the MIDI format) is provided concerning a desired music piece whose rendition-style-bearing music score is to be prepared. Then, for each performance part of the provided music score information, analysis is made, at step S41, to determine what styles of rendition are to be used at individual stages of the music piece. This rendition style analysis may be conducted by a human operator reading the music score and making judgements based on his or her musical knowledge. Of course, the rendition style analysis may be conducted by the CPU 10 executing a predetermined music-score analyzing program or by a combination of manual operation and automatic processing.

After that, for each performance part of the provided music score information, rendition style data, each designating one of the rendition styles determined at step S41 above, are added to locations within a time series of the performance data which correspond to necessary performance points corresponding to the rendition styles, at step S42. For example, rendition style data designating a given vibrato rendition style is imparted to a location corresponding to a performance point of a note or phrase where a vibrato is to be imparted, or rendition style data designating a given slur rendition style is imparted to a location corresponding to a performance point of a note or phrase which is to be performed in slur. The location where given rendition style data is to be added may be any suitable location, such as a location corresponding to a tone (e.g., the same location as a note-on event), a location corresponding to a midpoint (on-the-way point) of a tone (e.g., a rendition style event is inserted at a location corresponding to an appropriate time point that lies a predetermined time after a note-on event of the tone but before a note-off event of the tone), or a location corresponding to a phrase of a plurality of notes (e.g., an on event of a predetermined rendition style is inserted at the beginning of the phrase and an off event of the predetermined rendition style is inserted at the end of the phrase). Each of the rendition style data includes: "rendition style name" data specifying the name of one of a variety of rendition styles, such as vibrato, slur, staccato, glide and pitch bend; "rendition style parameter" data designating a degree of the rendition style; and "range" data indicating a time period or range to which the rendition style is to be imparted. The "range" data is data specifically indicating a rendition-style imparting range; for example, it may indicate that the rendition style should be imparted to only one corresponding tone or two tones immediately before and after the corresponding tone. In a situation where a particular rendition style is imparted to a relatively long range, the range may be designated by on and off events of the rendition style as mentioned above. Thus, performance data with the rendition style data added thereto in the above-mentioned manner are stored into an appropriate memory as rendition-style-bearing music score information, at step S43.

Figure 15:
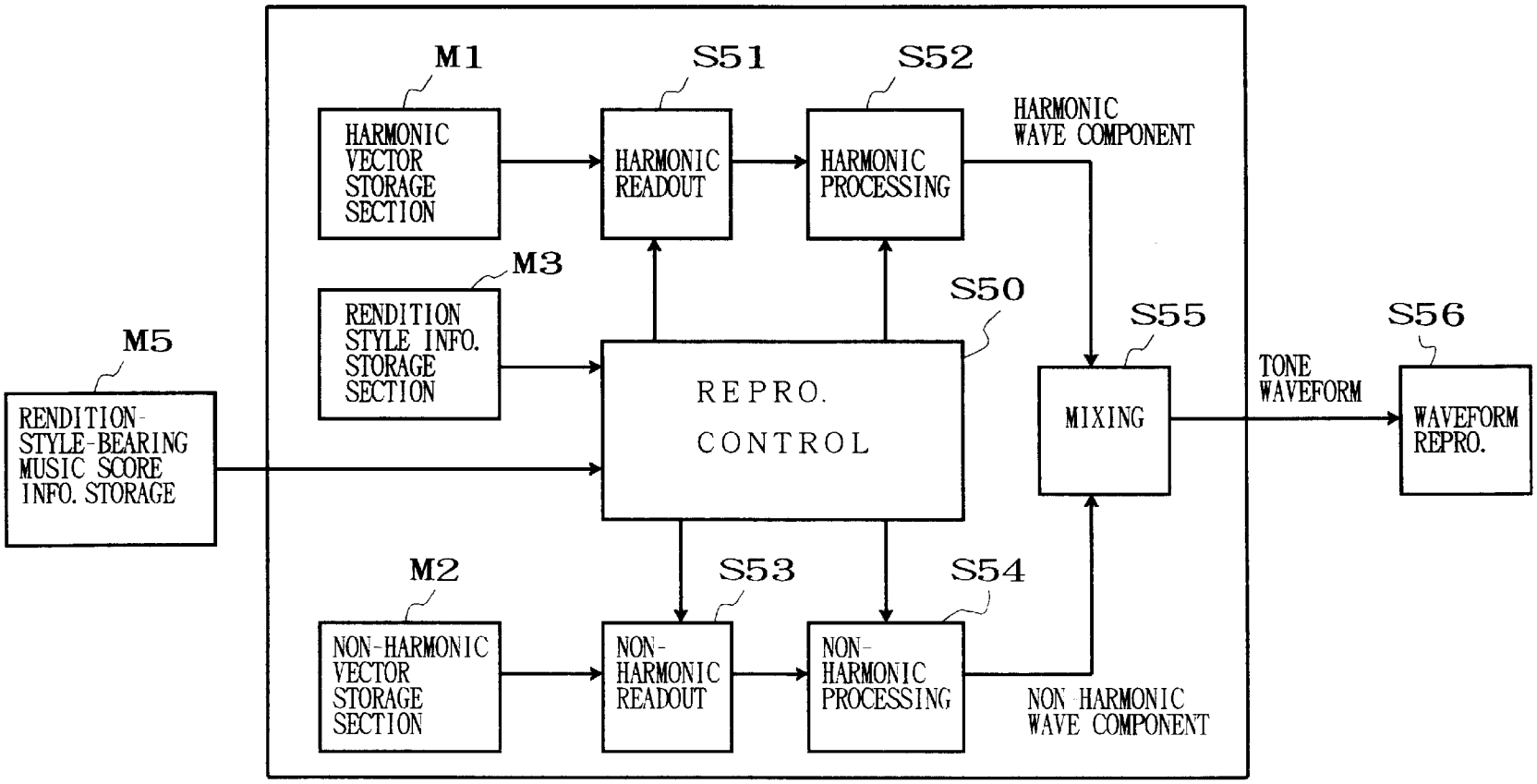
FIG. 15 is an equivalent block diagram outlining tone reproduction processing, i.e., waveform generation processing carried out under the control of the CPU shown in FIG. 1.

FIG. 15 is a functional block diagram showing an example of processing which is directed to an example of processing for reproducing a tone, i.e., generating a waveform, on the basis of rendition-style-bearing music score information prepared in the above-mentioned manner. This tone reproduction or waveform generation processing is carried out by the CPU 10 executing a predetermined software program, using the hardware of FIG. 1. In a "reproduction control" operation S50, performance data are read out sequentially, in accordance with predetermined tempo clock pulses, to generate a tone waveform having a pitch, tone color, etc. designated by the performance data, as generally known in the field of ordinary automatic performance sequence control. The reproduction control of step S50 is different from the ordinary automatic performance sequence control in that the performance data to be reproductively performed are composed of the "rendition-style-bearing music score information" prepared in the above-mentioned manner and that the reproduction control performs unique rendition style waveform reproduction/generation processing corresponding to rendition style data included in the music score information.

Further explaining the reproduction control of step S50, the performance data (e.g., MIDI data) of each performance part and rendition style data added thereto are reproductively read out sequentially from a "rendition-style-bearing music score information" storage section M5 in accordance with their respective performance timing. In response to readout of the rendition style data for any one of the performance parts in the "rendition-style-bearing music score information", a process is carried out to generate a rendition style waveform corresponding to the rendition style data, as will be described below. First, from the rendition-style information storage section M3, "rendition style information" is read out which pertains to a predetermined rendition style waveform, i.e., compressed data (first and second compressed data) of harmonic and non-harmonic wave components, that is designated by a combination of "musical instrument name" (tone color) specified for that performance part and "rendition style name" and "rendition style parameter" data included in the rendition style data. As previously noted, the compressed data of the harmonic wave component (first compressed data) include "vector information" indicating a harmonic vector, "section information", "pitch vector", "amplitude vector", "time vector", "information for controlling a form of cross-fading loop reproduction", etc. The compressed data of the non-harmonic wave component (second compressed data) include "vector information" indicating a non-harmonic vector, "section information", "pasting information" indicating a reproduction mode therefor, "amplitude vector", "time vector", etc.

In a "harmonic readout" operation S51, a harmonic vector is read out from the harmonic vector storage section M1 on the basis of the "vector information" included in the compressed data of the harmonic wave component (first compressed data).

In a "harmonic processing" operation S52, a given harmonic component waveform is reproduced/generated on the basis of the harmonic vector and other information included in the compressed data (such as the section information, pitch vector, amplitude vector, time vector and information for controlling a form of cross-fading loop reproduction). More specifically, the waveform of the harmonic vector is looped (repeated) as appropriate in accordance with the section information, the pitch of the harmonic vector waveform is controlled over time in accordance with the pitch vector (of course, the fundamental pitch of the waveform can be set/controlled in accordance with note data included in the MIDI performance data), and the time-axial position of the waveform data is controlled to be stretched or contracted in accordance with the time vector. Further, in accordance with the information for controlling a form of cross-fading loop reproduction, cross-fading amplitude envelope control is performed on the harmonic vector waveform with fade-in or fade-out characteristics.

In a "harmonic readout" operation S53, a non-harmonic vector is read out from the non-harmonic vector storage section M2 on the basis of the "vector information" included in the compressed data of the non-harmonic wave component (second compressed data).

In a "non-harmonic processing" operation S54, a given non-harmonic component waveform is reproduced/generated on the basis of the non-harmonic vector and other information included in the compressed data (such as the section information, pasting information, amplitude vector and time vector). More specifically, in accordance with the pasting information and section information, the waveform of the non-harmonic vector is pasted to a given section in an appropriate looped fashion or only once, depending on a non-harmonic wave component reproduction mode selected from among the one-shot reproduction, loop reproduction, sequence reproduction, etc. Further, the amplitude envelope of the non-harmonic vector waveform is set/controlled in accordance with the amplitude vector, and the time-axial position of the non-harmonic waveform data is controlled to be stretched or contracted in accordance with the time vector.

Now, let it be assumed that where the compressed data of the non-harmonic wave component to be reproduced are based on the above-mentioned first dividing technique (i.e., where the compressed data have been vector-quantized through the waveform division synchronized with the periodicity of the corresponding harmonic wave component), the time length of a non-harmonic vector, during or after readout of the non-harmonic vector from the non-harmonic vector storage section M2 responsive to the "vector information", is controlled to be stretched or contracted in accordance with the periodicity of the corresponding harmonic wave component to be reproduced concurrently with the non-harmonic wave component. This is because, in view of the nature of the waveform compression technique (the first dividing technique), the reproducibility of the non-harmonic component waveform can be improved by stretching or contracting the time length of the non-harmonic vector in synchronism with stretch/contraction in the periodicity of the harmonic wave component to be reproduced. The control to stretch or contract the time length of the non-harmonic vector may be performed either by simply varying a rate of the data readout from the non-harmonic vector storage section M2 or by employing time-axial stretch/contraction control. In the case where the compressed data of the non-harmonic wave component to be reproduced are based on the above-mentioned second dividing technique (i.e., where the compressed data have been vector-quantized through the waveform division irrespective of the periodicity of the corresponding harmonic wave component), such considerations need not necessarily be given. It should be obvious that the reproduction mode, such as the above-mentioned "one-shot reproduction", "loop reproduction", "alternate reproduction", "sequence reproduction", "random sequence reproduction" or "delete reproduction", can also be applied to the case where the compressed data of the non-harmonic wave component to be reproduced are based on the above-mentioned first dividing technique (i.e., where the compressed data have been vector-quantized through the waveform division synchronized with the periodicity of the corresponding harmonic wave component).

Further, in a "mixing" operation S55 of FIG. 15, the harmonic component waveform and non-harmonic component waveform, having been reproduced/generated in the above-mentioned manner, are mixed together to generate tone waveform data comprising a mixture of the two wave components. Thus, the tone waveform data is reproduced/provided at step S56. The thus-reproduced tone waveform data may be supplied to any other apparatus just as it is, i.e., in digital data form, or may be audibly reproduced via an appropriate sound system after being converted into analog representation. Note that signals of the harmonic component waveform and non-harmonic component waveform may be sounded separately and mixed together in space.

The above-described operations can reproduce/generate a tone waveform of characteristics considerably faithful to an original waveform while using a compressed data format. Further, by variably controlling the waveform processing of steps S52 and S54, it is possible to provide extremely useful waveform generation processing, also very rich in controllability, while assuring a high-quality waveform faithful to the original waveform.

In summary, the present invention is characterized in that input waveform data are separated into harmonic and non-harmonic wave components and the thus-separated harmonic and non-harmonic wave components are separately subjected to a vector quantization process. By vector-quantizing both of the harmonic and non-harmonic wave components, the present invention can significantly enhance a waveform compressing efficiency. Further, because there is no need to perform the vector quantization taking into account a combination of a periodic vector and noise vector as in the conventionally-known techniques and because vectors of the harmonic and non-harmonic wave components are selected independently of each other, the present invention can perform the vector quantization process with greater facility. In addition, because the vector quantization of a non-periodic wave component is performed on the basis of the non-harmonic wave component separated from the original waveform, the non-periodic wave component can be reproduced with increased accuracy. The present invention thus arranged can provide a waveform compression technique and waveform generation technique which significantly facilitate selection of vectors and achieve a superior data compressing efficiency in the vector quantization and superior reproducibility of the original waveform.

The present invention is also characterized in that the vector quantization process of a non-harmonic wave component is carried out by dividing the non-harmonic component waveform into a plurality of sections on the basis of the periodicity of the corresponding harmonic wave component. With this arrangement, the present invention can readily divide the non-harmonic component waveform into the waveform sections without requiring much human labor, thereby facilitating waveform-analyzing work necessary for the waveform division. Further, because the vector quantization of a non-periodic wave component is performed on the basis of a peculiar non-harmonic wave component constituting the original waveform in conjunction with the harmonic wave component, the present invention affords various benefits; for example, it can reproduce the non-periodic wave component with increased accuracy. As a result, the present invention can greatly facilitate the process to compress the non-harmonic wave component, is very useful for realizing the vector quantization of the non-harmonic wave component, can greatly contribute to an enhanced waveform compression efficiency, and achieves very superior reproducibility of the original waveform and, in particular, non-harmonic wave component.

The present invention is also characterized in that the non-harmonic wave component is divided into a plurality of waveform sections on the basis of a waveform shape of the non-harmonic wave component and the vector quantization process is performed for each of the divided sections. With this arrangement, the present invention can divide, into a plurality of waveform sections, the non-harmonic component waveform at locations that are considered appropriate by the waveform shape of the non-harmonic wave component, so that the present invention can readily perform the vector quantization process independently by analyzing the waveform of the non-harmonic wave component (non-periodic wave component) itself. Further, because the vector quantization of the non-periodic wave component is performed on the basis of a peculiar non-harmonic wave component constituting the original waveform in conjunction with the harmonic wave component, the present invention can reproduce the non-periodic wave component with increased accuracy.

Furthermore, by not designating a non-harmonic vector in compressing a non-harmonic component waveform of a given section so that a waveform is generated for that section using waveform data of a harmonic wave component without any non-harmonic wave component, the present invention can safely ignore the non-harmonic wave component present in such a section that is not so important in characterizing a sound, and thus can construct a reproduced waveform using only the harmonic wave component with the non-harmonic wave component muted for that section. Accordingly, it is possible to enhance the data compressing efficiency of the non-harmonic wave component.

Besides, by repetitively using a predetermined non-harmonic vector in compressing a non-harmonic wave component for a given section so that the non-harmonic wave component is reproduced in a looped fashion while taking into consideration the sound-characterizing importance for each of the sections, the present invention can correspondingly enhance the data compressing efficiency of the non-harmonic wave component.

Furthermore, in the present invention, waveform data of the harmonic wave component and compressed data of the non-harmonic wave component are provided in correspondence with a rendition style designated from a plurality of different rendition styles, a non-harmonic vector is selected, on the basis of the compressed data of the non-harmonic wave component, from among a plurality of non-harmonic vectors stored in memory so that waveform data of the non-harmonic wave component are generated on the basis of the selected non-harmonic vector. With this arrangement, the present invention can independently reproduce/generate a waveform of the non-harmonic wave component with the compressed data of the non-harmonic wave component, in correspondence with the designated rendition style. Further, by mixing the thus-reproduced non-harmonic component waveform with the harmonic component waveform, the present invention can reproduce a unique original waveform corresponding to the designated rendition style.

What is claimed is:

1. A waveform compression method comprising:

a step of separating input waveform data into a harmonic wave component and a non-harmonic wave component;

a step of providing a harmonic vector;

a step of generating first compressed data by vector-quantizing the harmonic wave component, separated from the input waveform data by said step of separating, using the harmonic vector;

a step of providing a non-harmonic vector; and a step of generating second compressed data by vector-quantizing the non-harmonic wave component separated from the input waveform data by said step of separating, using the non-harmonic vector.

2. A waveform compression method as claimed in claim 1 wherein said step of generating second compressed data includes a step of analyzing a characteristic of the separated non-harmonic wave component, and a step of selecting, on the basis of the analyzed characteristic of the separated non-harmonic wave component, a non-harmonic vector suitable for use as a representative vector of the non-harmonic wave component, whereby there is generated said second compressed data including information indicating the selected non-harmonic vector.

3. A waveform compression method as claimed in claim 1 wherein said step of providing a non-harmonic vector provides the non-harmonic vector via a memory storing a plurality of non-harmonic vectors, and said step of generating second compressed data includes a step of selecting a non-harmonic vector suitable for use as a representative vector of the non-harmonic wave component by searching through said memory for the suitable non-harmonic vector, whereby there is generated said second compressed data including information indicating the selected non-harmonic vector.

4. A waveform compression method as claimed in claim 3 wherein said step of selecting a non-harmonic vector includes a step of, when a particular non-harmonic vector suitable for use as the representative vector of the non-harmonic wave component is present in said memory, selecting the particular non-harmonic vector as the representative vector, and a step of, when a particular non-harmonic vector suitable for use as the representative vector of the non-harmonic wave component is not present in said memory, registering the particular non-harmonic vector into said memory as a new non-harmonic vector.

5. A waveform compression method as claimed in claim 1 wherein said step of generating second compressed data includes a step of generating such second compressed data that includes information indicating that no non-harmonic wave component should be used for a particular time section.

6. A waveform compression method as claimed in claim 1 wherein said step of generating second compressed data includes a step of generating such second compressed data that includes information indicating that a single non-harmonic vector should be used for a particular time section just once to thereby reproduce a non-harmonic wave component.

7. A waveform compression method as claimed in claim 1 which further comprises a step of sampling an actual performance tone of a musical instrument, and wherein said step of separating inputs waveform data of the actual performance tone sampled by said step of sampling and separates the input waveform data of the actual performance tone into a harmonic wave component and a non-harmonic wave component.

8. A waveform compression method as claimed in claim 1 wherein Fourier analysis is performed on a predetermined time section of the input waveform data, and the waveform data in the predetermined time section are separated into a harmonic wave component and a non-harmonic wave component on the basis of a result of the Fourier analysis.

9. A waveform compression method comprising:

a step of separating input waveform data into a harmonic wave component and a non-harmonic wave component;

a step of providing a harmonic vector;

a step of generating first compressed data by vector-quantizing the harmonic wave component, separated from the input waveform data by said step of separating, using the harmonic vector;

a step of providing a non-harmonic vector; and a step of generating second compressed data by vector-quantizing the non-harmonic wave component separated from the input waveform data by said step of separating, using the non-harmonic vector, wherein said step of separating includes a step of dividing the input waveform data into one or more rendition style sections in accordance with a rendition-style-related characteristic of the input waveform data, and a step of separating waveform data of each of the rendition style sections into a harmonic wave component and a non-harmonic wave component.

10. A waveform compression method as claimed in claim 9 wherein said step of separating includes a step of analyzing the rendition-style-related characteristic of the input waveform data so that the input waveform data is divided into the rendition style sections on the basis of the analyzed rendition-style-related characteristic, and a step of imparting information descriptive of the analyzed rendition-style-related characteristic to each of the divided rendition style sections.

11. A waveform compression method comprising:

a step of separating input waveform data into a harmonic wave component and a non-harmonic wave component;

a step of providing a harmonic vector;

a step of generating first compressed data by vector-quantizing the harmonic wave component, separated from the input waveform data by said step of separating, using the harmonic vector;

a step of providing a non-harmonic vector; and a step of generating second compressed data by vector-quantizing the non-harmonic wave component separated from the input waveform data by said step of separating, using the non-harmonic vector, wherein said step of generating second compressed data includes a step of generating such second compressed data that includes, for a particular time section, vector information indicative of a specific non-harmonic vector smaller in time length than the particular time section and information indicating that the specific non-harmonic vector should be used repetitively to reproduce a non-harmonic wave component.

12. A waveform compression method comprising:

a step of separating input waveform data into a harmonic wave component and a non-harmonic wave component;

a step of providing a harmonic vector;

a step of generating first compressed data by vector-quantizing the harmonic wave component, separated from the input waveform data by said step of separating, using the harmonic vector;

a step of providing a non-harmonic vector; and a step of generating second compressed data by vector-quantizing the non-harmonic wave component separated from the input waveform data by said step of separating, using the non-harmonic vector, wherein said step of generating second compressed data includes a step of generating such second compressed data that includes, for a particular time section, vector information indicative of a plurality of specific non-harmonic vectors smaller in time length than the particular time section and information indicating that the plurality of specific non-harmonic vectors should be used in a predetermined sequence to reproduce a non-harmonic wave component.

13. A waveform compression method comprising:

a step of separating input waveform data into a harmonic wave component and a non-harmonic wave component;

a step of providing a harmonic vector;

a step of generating first compressed data by vector-quantizing the harmonic wave component, separated from the input waveform data by said step of separating, using the harmonic vector;

a step of providing a non-harmonic vector; and a step of generating second compressed data by vector-quantizing the non-harmonic wave component separated from the input waveform data by said step of separating, using the non-harmonic vector, wherein said step of generating second compressed data includes a step of generating such second compressed data that includes, for a particular time section, vector information indicative of a plurality of specific non-harmonic vectors smaller in time length than the particular time section and information indicating that the plurality of specific non-harmonic vectors should be used randomly to reproduce a non-harmonic wave component.

14. A waveform compression apparatus comprising:

an input device adapted to provide waveform data to be compressed;

a memory storing a plurality of harmonic vectors and a plurality of non-harmonic vectors; and a processor coupled with said input device and said memory, said processor being adapted to:

separate the waveform data, provided by said input device, into a harmonic wave component and a non-harmonic wave component;

generate first compressed data by vector-quantizing the separated harmonic wave component using any one of the harmonic vectors stored in said memory; and generate second compressed data by vector-quantizing the separated non-harmonic wave component using any one of the non-harmonic vectors stored in said memory.

15. A machine-readable storage medium containing a group of instructions to cause said machine to implement a waveform compression method, said method comprising:

a step of separating input waveform data into a harmonic wave component and a non-harmonic wave component;

a step of providing a harmonic vector;

a step of generating first compressed data by vector-quantizing the harmonic wave component, separated from the input waveform data by said step of separating, using the harmonic vector;

a step of providing a non-harmonic vector; and a step of generating second compressed data by vector-quantizing the non-harmonic wave component, separated from the input waveform data by said step of separating, using the non-harmonic vector.

16. A waveform generation method comprising:

a step of receiving first compressed data including vector information indicative of a harmonic vector and second compressed data including vector information indicative of a non-harmonic vector;

a step of providing a harmonic vector;

a step of synthesizing waveform data of a harmonic wave component on the basis of said first compressed data and the harmonic vector indicated thereby;

a step of providing a non-harmonic vector; and a step of synthesizing waveform data of a non-harmonic wave component on the basis of said second compressed data and the non-harmonic vector indicated thereby.

17. A waveform generation method as claimed in claim 16 which further comprises a step of generating synthesized waveform data by combining the waveform data of the harmonic wave component and the waveform data of the non-harmonic wave component synthesized by said step of synthesizing.

18. A waveform generation apparatus comprising:

a memory storing a plurality of harmonic vectors and a plurality of non-harmonic vectors; and a processor coupled with said memory, said processor being adapted to:

receive first compressed data including vector information indicative of a harmonic vector and second compressed data including vector information indicative of a non-harmonic vector;

read out, from said memory, the harmonic vector indicated by said first compressed data and synthesize waveform data of a harmonic wave component on the basis of the read-out harmonic vector; and read out, from said memory, the non-harmonic vector indicated by said second compressed data and synthesize waveform data of a non-harmonic wave component on the basis of the read-out non-harmonic vector.

19. A machine-readable storage medium containing a group of instructions to cause said machine to implement a waveform generation method, said method comprising:

a step of receiving first compressed data including vector information indicative of a harmonic vector and second compressed data including vector information indicative of a non-harmonic vector;

a step of providing a harmonic vector;

a step of synthesizing waveform data of a harmonic wave component on the basis of said first compressed data and the harmonic vector indicated thereby;

a step of providing a non-harmonic vector; and a step of synthesizing waveform data of a non-harmonic wave component on the basis of said second compressed data and the non-harmonic vector indicated thereby.

20. A waveform compression method comprising:

a step of providing separately a harmonic wave component and a non-harmonic wave component of waveform data to be compressed;

a step of detecting periodicity of the harmonic wave component provided by said step of providing;

a step of dividing the non-harmonic wave component into a plurality of sections on the basis of the periodicity of the harmonic wave component detected by said step of detecting;

a step of providing a non-harmonic vector; and a step of generating compressed data of a non-harmonic wave component by vector-quantizing a non-harmonic wave component of each of the sections using the non-harmonic vector.

21. A waveform compression apparatus comprising:

a memory storing a plurality of non-harmonic vectors; and a processor coupled with said memory, said processor being adapted to:

obtain separately a harmonic wave component and a non-harmonic wave component of waveform data to be compressed;

detect periodicity of the obtained harmonic wave component;

divide the obtained non-harmonic wave component into a plurality of sections on the basis of the detected periodicity of the harmonic wave component;

generate compressed data of a non-harmonic wave component by vector-quantizing a non-harmonic wave component of each of the sections using the non-harmonic vector stored in said memory.

22. A machine-readable storage medium containing a group of instructions to cause said machine to implement a waveform compression method, said method comprising:

a step of providing separately a harmonic wave component and a non-harmonic wave component of waveform data to be compressed;

a step of detecting periodicity of the harmonic wave component provided by said step of providing;

a step of dividing the non-harmonic wave component into a plurality of sections on the basis of the periodicity of the harmonic wave component detected by said step of detecting;

a step of providing a non-harmonic vector; and a step of generating compressed data of a non-harmonic wave component by vector-quantizing a non-harmonic wave component of each of the sections using the non-harmonic vector.

23. A waveform generation method comprising:

a step of receiving compressed data of a non-harmonic wave component including vector information indicative of a non-harmonic vector;

a step of providing waveform data of a harmonic wave component to be generated simultaneously;

a step of providing a non-harmonic vector;

a step of selecting a non-harmonic vector on the basis of the compressed data of the non-harmonic wave component;

a step of performing stretch/contraction control of a time-axial length of the non-harmonic vector selected by said step of selecting, in accordance with periodicity of the waveform data of the harmonic wave component; and a step of synthesizing waveform data of a non-harmonic wave component on the basis of the non-harmonic vector having been subjected to the stretch/contraction control by said step of controlling.

24. A waveform generation method as claimed in claim 23 which further comprises a step of generating synthesized waveform data by combining the waveform data of the harmonic wave component provided by said step of providing and the waveform data of the non-harmonic wave component synthesized by said step of synthesizing.

25. A waveform generation apparatus comprising:

a memory storing a plurality of non-harmonic vectors; and a processor coupled with said memory, said processor being adapted to:

receive compressed data of a non-harmonic wave component including vector information indicative of a non-harmonic vector;

select a non-harmonic vector from among the plurality of non-harmonic vectors stored in said memory, on the basis of the vector information in the received waveform data of the non-harmonic wave component;

perform stretch/contraction control of a time-axial length of the selected non-harmonic vector, in accordance with periodicity of waveform data of a harmonic wave component to be generated simultaneously; and synthesize waveform data of a non-harmonic wave component on the basis of the non-harmonic vector having been subjected to the stretch/contraction control.

26. A waveform generation apparatus as claimed in claim 25 wherein said processor is also adapted to provide the waveform data of the harmonic wave component to be generated simultaneously and generate synthesized waveform data by combining the provided waveform data of the harmonic wave component and the synthesized waveform data of the non-harmonic wave component.

27. A machine-readable storage medium containing a group of instructions to cause said machine to implement a waveform generation method, said method comprising:

a step of receiving compressed data of a non-harmonic wave component including vector information indicative of a non-harmonic vector;

a step of providing waveform data of a harmonic wave component to be generated simultaneously;

a step of providing a non-harmonic vector;

a step of selecting a non-harmonic vector on the basis of the compressed data of the non-harmonic wave component;

a step of performing stretch/contraction control of a time-axial length of the non-harmonic vector selected by said step of selecting, in accordance with periodicity of the waveform data of the harmonic wave component; and a step of synthesizing waveform data of a non-harmonic wave component on the basis of the non-harmonic vector having been subjected to the stretch/contraction control by said step of controlling.

28. A waveform compression method comprising:

a step of providing separately a harmonic wave component and a non-harmonic wave component of waveform data to be compressed;

a step of dividing the non-harmonic wave component into a plurality of sections on the basis of a waveform shape of the non-harmonic wave component;

a step of providing a non-harmonic vector; and a step of generating compressed data of a non-harmonic wave component by vector-quantizing a non-harmonic wave component of each of the sections using the non-harmonic vector.

29. A waveform compression method as claimed in claim 28 wherein said step of generating compressed data selects, for each of the sections, a non-harmonic vector corresponding to a representative vector for the section and generate the compressed data including vector information indicative of the selected non-harmonic vector.

30. A waveform compression method as claimed in claim 29 wherein said step of providing a non-harmonic vector provides the non-harmonic vector via a memory storing a plurality of non-harmonic vectors, and where when a particular non-harmonic vector suitable for use as the representative vector for a given one of the sections is present in said memory, said step of generating compressed data selects the particular non-harmonic vector, but, when the particular non-harmonic vector suitable for use as the representative vector of the given section is not present in said memory, said step of generating compressed data registers the particular non-harmonic vector into said memory as a new non-harmonic vector.

31. A waveform compression method as claimed in claim 28 wherein said step of generating compressed data generates compressed data including information indicating that no non-harmonic wave component should be used for a given one of the sections.

32. A waveform compression method as claimed in claim 28 wherein said step of providing a non-harmonic vector includes providing a plurality of non-harmonic vectors obtained from a plurality of different original waveforms, and wherein said step of generating compressed data is capable of designating the plurality of non-harmonic vectors, obtained from the plurality of different original waveforms, as respective representative vectors of a plurality of sections divided from a given non-harmonic wave component.

33. A waveform compression apparatus comprising:

a memory storing a plurality of non-harmonic vectors; and a processor coupled with said memory, said processor being adapted to:

obtain a non-harmonic wave component of waveform data to be compressed;

divide the non-harmonic wave component into a plurality of sections on the basis of a waveform shape of the non-harmonic wave component; and generate compressed data of a non-harmonic wave component by vector-quantizing a non-harmonic wave component of each of the sections using the non-harmonic vector stored in said memory.

34. A machine-readable storage medium containing a group of instructions to cause said machine to implement a waveform compression method, said method comprising:

a step of providing separately a harmonic wave component and a non-harmonic wave component of waveform data to be compressed;

a step of dividing the non-harmonic wave component into a plurality of sections on the basis of a waveform shape of the non-harmonic wave component;

a step of providing a non-harmonic vector; and a step of generating compressed data of a non-harmonic wave component by vector-quantizing a non-harmonic wave component of each of the sections using the non-harmonic vector.

35. A waveform generation method comprising:

a step of providing waveform data of a harmonic wave component;

a step of providing compressed data of non-harmonic wave components, respectively, for a plurality of sections, a step of providing a non-harmonic vector; and a step of selecting a non-harmonic vector on the basis of the compressed data of the non-harmonic wave component for each of the sections and generating waveform data of a non-harmonic wave component for each of the sections on the basis of the selected non-harmonic vector, wherein a waveform is generated by combining the waveform data of the harmonic wave component and the waveform data of the non-harmonic wave component, the waveform data for a given one of the sections include information indicating that no non-harmonic vector should be used for the given section and thereby waveform data of a harmonic wave component are generated for the given section without a non-harmonic wave component.

36. A waveform generation method comprising:

a step of providing waveform data of a harmonic wave component;

a step of providing compressed data of non-harmonic wave components, respectively, for a plurality of sections, a step of providing a non-harmonic vector; and a step of selecting a non-harmonic vector on the basis of the compressed data of the non-harmonic wave component for each of the sections and generating waveform data of a non-harmonic wave component for each of the sections on the basis of the selected non-harmonic vector, wherein a waveform is generated by combining the waveform data of the harmonic wave component and the waveform data of the non-harmonic wave component, the waveform data for a given one of the sections include information indicating that the non-harmonic vector should be used repetitively for the given section and thereby waveform data of a non-harmonic wave component are generated for the given section by repeating the non-harmonic vector.

37. A waveform generation method comprising:

a step of providing waveform data of a harmonic wave component in correspondence with a rendition style designated from among a plurality of different rendition styles;

a step of providing waveform data of a non-harmonic wave component in correspondence with the designated rendition style;

a step of providing non-harmonic vectors via a memory storing a plurality of non-harmonic vectors; and a step of, on the basis of the waveform data of the harmonic wave component, selecting a non-harmonic vector from among the plurality of non-harmonic vectors provided via said memory and generating waveform data of a non-harmonic wave component on the basis of the selected non-harmonic vector, wherein a waveform corresponding to the designated rendition style is generated by combining the waveform data of the harmonic wave component and the waveform data of the non-harmonic wave component.

38. A waveform generation apparatus comprising:

a memory storing a plurality of non-harmonic vectors; and a processor coupled with said memory, said processor being adapted to:

generate waveform data of a harmonic wave component in correspondence with a rendition style designated from among a plurality of different rendition styles;

receive compressed waveform data of a non-harmonic wave component in correspondence with the designated rendition style;

on the basis of the compressed waveform data of the non-harmonic wave component, select a non-harmonic vector from among the plurality of non-harmonic vectors stored in said memory and generate waveform data of a non-harmonic wave component on the basis of the selected non-harmonic vector; and generate a waveform corresponding to the designated rendition style by combining the waveform data of the harmonic wave component and the waveform data of the non-harmonic wave component.

39. A waveform compression method comprising:

a step of providing separately a harmonic wave component and a non-harmonic wave component of waveform data to be compressed;

a step of providing a harmonic vector;

a step of generating first compressed data by vector-quantizing the harmonic wave component, separated from the input waveform data be said step of separating, using the harmonic vector;

a step of providing a non-harmonic vector; and a step of generating second compressed data by vector-quantizing the non-harmonic wave component separated from the input waveform data by said step of separating, using the non-harmonic vector.

* * * * *